US010941476B2

(12) United States Patent
Ueno et al.

(10) Patent No.: US 10,941,476 B2
(45) Date of Patent: Mar. 9, 2021

(54) HIGH STRENGTH STEEL SHEET AND METHOD FOR PRODUCING THE SAME

(71) Applicant: JFE Steel Corporation, Tokyo (JP)

(72) Inventors: Takashi Ueno, Tokyo (JP); Hiroshi Hasegawa, Tokyo (JP); Yoshimasa Funakawa, Tokyo (JP); Yoshimasa Himei, Tokyo (JP); Yoshikazu Suzuki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 259 days.

(21) Appl. No.: 16/071,581

(22) PCT Filed: Jan. 20, 2017

(86) PCT No.: PCT/JP2017/001980
§ 371 (c)(1),
(2) Date: Jul. 20, 2018

(87) PCT Pub. No.: WO2017/126678
PCT Pub. Date: Jul. 27, 2017

(65) Prior Publication Data

US 2019/0032186 A1 Jan. 31, 2019

(30) Foreign Application Priority Data

Jan. 22, 2016 (JP) ..... JP2016-010606

(51) Int. Cl.
*C23C 2/06* (2006.01)
*C21D 9/46* (2006.01)
(Continued)

(52) U.S. Cl.
CPC ..... *C23C 2/06* (2013.01); *C21D 1/26* (2013.01); *C21D 8/0247* (2013.01);
(Continued)

(58) Field of Classification Search
CPC ..... C23C 2/06; C21D 8/0247; C21D 9/46; C22C 38/00
See application file for complete search history.

(56) References Cited

U.S. PATENT DOCUMENTS 9,896,751 B2 2/2018 Kawata et al.
2010/0307644 A1 12/2010 Otin et al.
(Continued)

FOREIGN PATENT DOCUMENTS

CN 101932746 A 12/2010
CN 101960033 A 1/2011
(Continued)

OTHER PUBLICATIONS

Korean Office Action for Korean Application No. 10-2018-7020587, dated Aug. 22, 2019 with Concise Statement of Relevance of Office Action, 6 pages.
(Continued)

*Primary Examiner* — Christopher S Kessler
*Assistant Examiner* — Jiangtian Xu
(74) *Attorney, Agent, or Firm* — Ratnerprestia

(57) ABSTRACT

High strength steel sheets that have excellent ductility and low-temperature toughness and methods for producing such high strength steel sheets. A high strength steel sheet includes a composition containing, on a mass % basis, C: 0.05% to 0.30%, Si: 0.5% to 2.5%, Mn: 0.5% to 3.5%, P: 0.003% to 0.100%, S: 0.02% or less, Al: 0.010% to 1.5%, and N: 0.01% or less, the balance being Fe and unavoidable impurities, and a steel microstructure including a ferrite phase with an area fraction of 10% to 70%, a hard second phase with an area fraction of 30% to 90%, and a carbide that is at an interface between a ferrite phase and a hard second phase and that has an average equivalent-circle diameter of 200 nm or less.

21 Claims, 2 Drawing Sheets

(51) Int. Cl.

| | |
|---|---|
| ***C22C 38/06*** | (2006.01) |
| ***C23C 2/02*** | (2006.01) |
| ***C22C 38/00*** | (2006.01) |
| ***C22C 38/04*** | (2006.01) |
| ***C22C 38/60*** | (2006.01) |
| ***C23C 2/28*** | (2006.01) |
| ***C21D 8/02*** | (2006.01) |
| ***C23C 2/40*** | (2006.01) |
| ***C21D 1/26*** | (2006.01) |
| ***C21D 8/04*** | (2006.01) |
| ***C22C 38/02*** | (2006.01) |
| *C22C 18/04* | (2006.01) |
| *C22C 18/00* | (2006.01) |

(52) U.S. Cl.

CPC ..... *C21D 8/0273* (2013.01); *C21D 8/0447* (2013.01); *C21D 9/46* (2013.01); *C22C 38/00* (2013.01); *C22C 38/001* (2013.01); *C22C 38/02* (2013.01); *C22C 38/04* (2013.01); *C22C 38/06* (2013.01); *C22C 38/60* (2013.01); *C23C 2/02* (2013.01); *C23C 2/28* (2013.01); *C23C 2/40* (2013.01); *C21D 8/0226* (2013.01); *C21D 8/0236* (2013.01); *C21D 2211/001* (2013.01); *C21D 2211/002* (2013.01); *C21D 2211/005* (2013.01); *C21D 2211/008* (2013.01); *C21D 2211/009* (2013.01); *C22C 18/00* (2013.01); *C22C 18/04* (2013.01)

(56) References Cited

U.S. PATENT DOCUMENTS

| | | | | |
|---|---|---|---|---|
| 2011/0030854 | A1 | 2/2011 | Matsuda et al. | |
| 2014/0227555 | A1 | 8/2014 | Kawata et al. | |
| 2015/0299834 | A1 | 10/2015 | Mizuta et al. | |
| 2016/0208359 | A1* | 7/2016 | Kasuya ..... | C21D 8/0247 |

FOREIGN PATENT DOCUMENTS

| | | | |
|---|---|---|---|
| CN | 102333901 | A | 1/2012 |
| CN | 103717774 | A | 4/2014 |
| CN | 103987870 | A | 8/2014 |
| CN | 104762565 | A | 7/2015 |
| CN | 105579606 | A | 5/2016 |
| EP | 2246456 | A1 | 11/2010 |
| EP | 2402470 | A1 | 1/2012 |
| EP | 2695961 | A1 | 2/2014 |
| EP | 2762582 | A1 | 8/2014 |
| EP | 2792760 | A1 | 10/2014 |
| EP | 3050988 | A1 | 8/2016 |
| EP | 3101147 | A1 | 12/2016 |
| EP | 3106528 | A1 | 12/2016 |
| EP | 3112488 | A1 | 1/2017 |
| JP | 2009102715 | A | 5/2009 |
| JP | 2010526935 | A | 8/2010 |
| JP | 2014019894 | A | 2/2014 |
| JP | 2014037596 | A | 2/2014 |
| JP | 2015025208 | A | 2/2015 |
| JP | 2015200006 | A | 11/2015 |
| WO | 2013047755 | A1 | 4/2013 |
| WO | 2015115059 | A1 | 8/2015 |
| WO | 2015129199 | A1 | 9/2015 |
| WO | 2015162849 | A1 | 10/2015 |

OTHER PUBLICATIONS

International Search Report and Written Opinion for International Application No. PCT/JP2017/001980, dated Apr. 25, 2017—6 pages.

Chinese Office Action with Search Report for Chinese Application No. 201780007260.3, dated Jul. 22, 2019, 10 pages.

Chinese Office Action with Search Report for Chinese Application No. 201780007260,3, dated Mar. 18, 2020, 9 pages.

Korean Office Action for Korean Application No. 10-2018-7020587, dated Mar. 19, 2020, with Concise Statement of Relevance of Office Action, 5 pages.

Extended European Search Report for European Application No. 17 741 555.1, dated Oct. 16, 2018, 11 pages.

Korean Grant of Patent for Korean Application No. 10-2018-7020587, dated Jun. 26, 2020, with translation, 3 pages.

* cited by examiner

HIGH STRENGTH STEEL SHEET AND METHOD FOR PRODUCING THE SAME

CROSS REFERENCE TO RELATED APPLICATIONS

This is the U.S. National Phase application of PCT/JP2017/001980, filed Jan. 20, 2017, which claims priority to Japanese Patent Application No. 2016-010606, filed Jan. 22, 2016, the disclosures of these applications being incorporated herein by reference in their entireties for all purposes.

TECHNICAL FIELD OF THE INVENTION

The present invention relates to a high strength steel sheet that is suitable for components used mainly in the automotive field and that has excellent workability and low-temperature toughness and to a method for producing the high strength steel sheet.

BACKGROUND OF THE INVENTION

In recent years, from the viewpoint of global environmental conservation, improvement in fuel efficiency of vehicles has been an important issue. With such an issue, movement has been promoted in which the strength of materials for vehicle bodies is increased-to reduce the thickness of the materials, thereby reducing the weight of vehicle bodies. In addition, rust preventive properties are required in the above-described use, and thus a demand for a high strength steel sheet as a steel sheet in such a use has been growing.

An increase in the strength of steel sheets, however, results in deterioration of workability and low-temperature toughness. Therefore, the development of high strength steel sheets having high strength, high workability, and low-temperature toughness has been desired.

To satisfy such a demand, various multi-phase high strength hot-dip galvanized steel sheets, such as ferrite-martensite dual-phase steel (DP steel) and TRIP |[Ac] steel in which transformation-induced plasticity of retained austere is used, have been developed.

For example, Patent Literature 1 proposes a high strength hot-dip galvanized steel sheet that has a composition that contains, on a mass % basis, C: 0.05% to 0.3%, Si: 0.01% to 2.5%, Mn: 0.5% to 3.5%, P: 0.003% to 0.100%, S: 0.02% or less, Al: 0.010% to 1.5%, and further 0.01% to 0.2%, in total, of at least one element selected from Ti, Nb, and V, the balance being Fe and unavoidable impurities, and that has a microstructure which includes a ferrite phase with an area fraction of 20% to 87%, martensite and retained austenite with an area fraction of 3% to 10% in total, and tempered martensite with an area fraction of 10% to 60%, wherein the microstructure has a second phase that includes the martensite, retained austenite, and tempered martensite and has an average grain size of 3 μm or less. The high strength hot-dip galvanized steel sheet has excellent workability, excellent impact strength properties, and a tensile strength of 845 MPa or more. However, the steel sheets produced by the technique have poor low-temperature toughness, and thus the use as high strength steel sheets is practically limited.

Patent Literature 2 proposes a high strength hot-dip galvanized steel sheet that includes a base steel sheet containing, on a mass % basis, C: 0.075% to 0.400%, Si: 0.01% to 2.00%, Mn: 0.80% to 3.50%, P: 0.0001% to 0.100%, S: 0.0001% to 0.0100%, Al: 0.001% to 2.00%, O: 0.0001% to 0.0100%, and N: 0.0001% to 0.0100%, the balance being Fe and unavoidable impurities, a hot-dip galvanizing layer being formed on the surface of the base steel sheet. The base steel sheet includes, in the steel sheet microstructure in a range of ⅛ thickness to ⅜ thickness, with the center being a position of ¼ the thickness from the surface of the sheet, a retained austenite phase with a volume fraction of 5% or less, a ferrite phase with a volume fraction of 60% or less, and a bainite phase, a bainitic ferrite phase, a fresh martensite phase, and a tempered martensite phase with a volume fraction of 40% or more in total, has an effective average grain size of 5.0 μm or less and a maximum effective grain size of 20 μm or less in a range of ⅛ thickness to ⅜ thickness, with the center being a position of ¼ the thickness from the surface of the sheet, and has a decarburized layer that is formed in a surface layer portion and that has a thickness of 0.01 μm to 10.0 μm. The density of an oxide dispersed in the decarburized layer is $1.0\times10^{12}/m^2$ to $1.0\times10^{16}/m^2$, and the oxide has an average particle size of 500 nm or less. The high strength hot-dip galvanized steel sheet has excellent low-temperature toughness and impact strength properties. However, the steel sheets produced by the technique have poor ductility (workability), and thus the use as high strength steel sheets is practically limited.

PTL 1: Japanese Unexamined Patent Application Publication No. 2009-102715

PTL 2: International Publication No. WO2013/047755

SUMMARY OF THE INVENTION

As described above, high strength steel sheets are required to have excellent ductility (EL) and low-temperature toughness; however, there are no existing high strength steel sheets having high levels of such properties.|[A2]

The present invention is provided to solve the foregoing issue, and the object of the present invention is to provide a high strength steel sheet having excellent ductility and low-temperature toughness and a method for producing a high strength steel sheet.

The present inventors diligently conducted studies to solve the foregoing issue. As a result, alloying components and manufacturing conditions have been optimized, and the size of a carbide at the interface between a ferrite phase and a hard second phase has been controlled, thereby succeeding in manufacturing a high strength steel sheet having excellent ductility and low-temperature toughness. Aspects of the invention are as follows.

[1] A high strength steel sheet has a composition containing, on a mass % basis, C: 0.05% to 0.30%, Si: 0.5% to 2.5%, Mn: 0.5% to 3.5%, P: 0.003% to 0.100%, S: 0.02% or less, Al: 0.010% to 1.5%, and N: 0.01% or less, the balance being Fe and unavoidable impurities, and a steel microstructure including a ferrite phase with an area fraction of 10% to 70%, a hard second phase with an area fraction of 30% to 90%, and a carbide that is present at an interface between the ferrite phase and the hard second phase and that has an average equivalent-circle diameter of 200 nm or less.

[2] In the high strength steel sheet according to [1], the composition further contains, on a mass % basis, one or two or more elements selected from Cr: 0.005% to 2.00%, Mo: 0.005% to 2.00%, V: 0.005% to 2.00%, Ni: 0.005% to 2.00%, and Cu: 0.005% to 2.00%.

[3] In the high strength steel sheet according to [1] or [2], the composition further contains, on a mass % basis, one or two elements selected from Ti: 0.01% to 0.20% and Nb: 0.01% to 0.20%.

[4] In the high strength steel sheet according to any one of [1] to [3], the composition further contains, on a mass % basis, B: 0.0002% to 0.01%.

[5] In the high strength steel sheet according to any one of [1] to [4], the composition further contains, on a mass % basis, one or two elements selected from Sb: 0.001% to 0.05% and Sn: 0.001% to 0.05%.

[6] In the high strength steel sheet according to any one of [1] to [5], the hard second phase includes bainite and tempered martensite, and the bainite and the tempered martensite have an area fraction of 10% to 90% in total.

[7] In the high strength steel sheet according to any one of [1] to [6], the hard second phase includes as-quenched martensite, and the as-quenched martensite has an area fraction of 10% or less.

[8] In the high strength steel sheet according to any one of [1] to [7], the hard second phase includes retained austenite, and the retained austenite has an area fraction of 10% or less.

[9] In the high strength steel sheet according to any one of [1] to [8], the hard second phase includes pearlite, and the pearlite has an area fraction of 3% or less.

[10] The high strength steel sheet according to any one of [1] to [9] includes a galvanizing layer on a surface of the high strength steel sheet.

[11] A method for producing a high strength steel sheet, includes a hot-rolling step of rolling a slab having the composition according to any one of [1] to [5] at a finishing temperature that is $Ar_3$ transformation temperature or higher, then performing cooling at an average cooling rate of 20° C./s or more, and performing coiling at 550° C. lower than or equal to, an pickling step of removing an oxide scale of a surface of a hot-rolled steel sheet obtained in the hot-rolling step by performing pickling, a cold-rolling step of cold-rolling a pickled sheet after the pickling step, and an annealing step of heating a cold-rolled steel sheet obtained in the cold-rolling step to a temperature of 750° C. to 900° C. while heating the steel sheet at an average heating rate of 10° C./s or more in a temperature range of 500° C. to $Ac_1$ transformation temperature and cooling the steel sheet to a cooling stop temperature lower than or equal to (Ms temperature—100° C.) while cooling the steel sheet at an average cooling rate of 10° C./s or more to a temperature of (Ms temperature—100° C.), wherein a retention time in a temperature range of 750° C. to 900° C. is 10 seconds or more in the heating and the cooling, wherein when the cooling stop temperature falls below 150° C., after the cooling is performed to a temperature lower than or equal to (Ms temperature—100° C.), the steel sheet is heated at an average heating rate of 30° C./s or more to a temperature of 150° C. or higher and 350° C. or lower and retained in a temperature range of 150° C. or higher and 350° C. or lower for 10 seconds or more and 600 seconds or less, and wherein when the cooling stop temperature is 150° C. or higher, after the cooling is performed to a temperature lower than or equal to (Ms temperature—100° C.), the steel sheet is heated at an average heating rate of 30° C./s or more to a temperature of 150° C. or higher and 350° C. or lower and retained in a temperature range of 150° C. or higher and 350° C. or lower for 10 seconds or more and 600 seconds or less, or after the cooling is performed to a temperature lower than or equal to (Ms temperature—100° C.), the steel sheet is retained in a temperature range of 150° C. or higher and 350° C. or lower for 10 seconds or more and 600 seconds or less.

[12] The method for producing a high strength steel sheet according to [11] includes, after the annealing step, a galvanizing step of heating an annealed sheet at an average heating rate of 30° C./s or more to a sheet temperature at which the sheet is immersed in a hot-dip galvanizing bath and performing hot-dip galvanizing.

[13] In the method for producing a high strength steel sheet according to [12], the galvanizing step includes, after the hot-dip galvanizing, performing alloying treatment by performing heating at an average heating rate of 30° C./s or more to a temperature range of 500° C. to 570° C. and performing retention in the temperature range for a retention time of 30 seconds or less.

According to the present invention, a high strength steel sheet that has excellent ductility and low-temperature toughness is obtained. The use of the high strength steel sheet according to the present invention for automotive structure members achieves both a lighter vehicle weight and an improvement in collision safety. In other words, the present invention considerably contributes to achieving higher performance of vehicle bodies.

DETAILED DESCRIPTION OF EMBODIMENTS OF THE INVENTION

Figure 1:
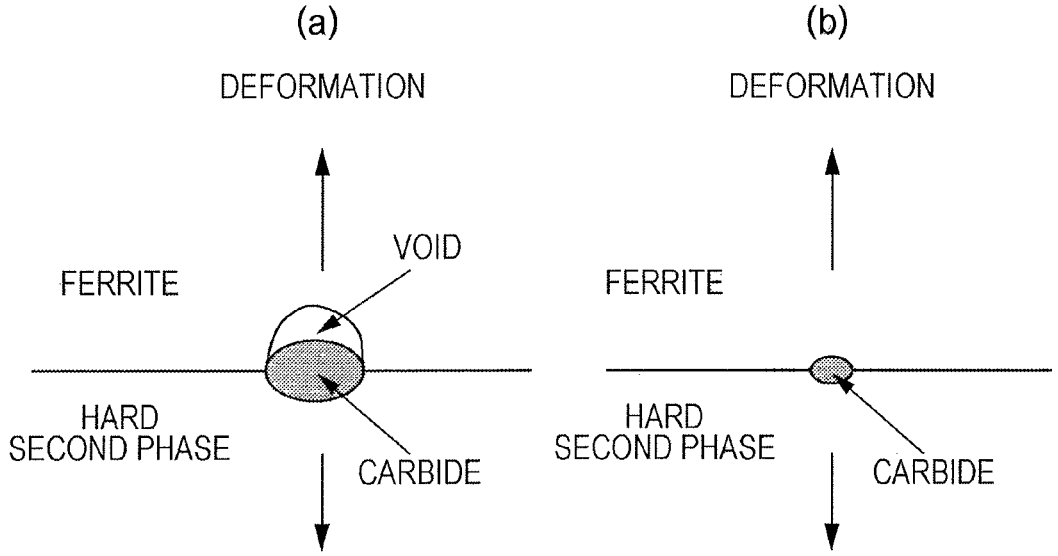
FIG. 1 is a schematic illustration of an initiation behavior of a void in hole expansion deformation.

Hereinafter, an embodiment of the present invention will be described. The present invention is not limited to the following embodiment.

The high strength steel sheet of the present invention (sometimes simply referred to as a "steel sheet") will be described. The steel sheet has a specific composition and steel microstructure. The composition and the steel microstructure will be described in this order.

The steel sheet has a composition containing, on a mass % basis, C: 0.05% to 0.30%, Si: 0.5% to 2.5%, Mn: 0.5% to 3.5%, P: 0.003% to 0.100%, S: 0.02% or less, Al: 0.010% to 1.5%, and N: 0.01% or less, the balance being Fe and unavoidable impurities.

The composition may further contain, on a mass % basis, one or two or more elements selected from Cr: 0.005% to 2.00%, Mo: 0.005% to 2.00%, V: 0.005% to 2.00%, Ni: 0.005% to 2.00%, and Cu: 0.005% to 2.00%.

The composition may further contain, on a mass % basis, one or two elements selected from Ti: 0.01% to 0.20% and Nb: 0.01% to 0.20%.

The composition may further contain, on a mass % basis, B: 0.0002% to 0.01%.

The composition may further contain, on a mass % basis, one or two elements selected from Sb: 0.001% to 0.05% and Sn: 0.001% to 0.05%.

Hereinafter, each component will be described. In the description of the components, "%" that represents the content refers to "mass %".

C: 0.05% to 0.30%

C stabilizes austenite and causes a hard second phase to be easily generated, thereby increasing a tensile strength. C is an element necessary for making a composite microstructure to improve the balance between tensile strength and ductility. When the C content falls below 0.05%, even if manufacturing conditions are optimized, the hard second phase is not in a desired state. As a result, a tensile strength of 590 MPa or more cannot be achieved. In contrast, when the C content exceeds 0.30%, carbide particles at the interface between a ferrite phase and a hard second phase are coarsened, and thus the low-temperature toughness and further the hole expansion ratio deteriorate. Therefore, the C content is 0.05% or more and 0.30% or less. The lower limit of the C content is preferably 0.06% or more. The upper limit of the C content is preferably 0.15% or less.

Si: 0.5% to 2.5%

Si is an element effective for an increase in the steel tensile strength. Si is a ferritizer and suppresses the formation of a carbide, thereby improving the ductility and the low-temperature toughness and further a hole expansion ratio. Such effects are exhibited when the Si content is 0.5% or more. The Si content is preferably more than 0.5%, more preferably 0.6% or more, and further preferably 0.8% or more. An excessive Si content results in excessive solid solution strengthening of the ferrite phase, thereby deteriorating the ductility. Therefore, the Si content is 2.5% or less. The upper limit of the Si content is preferably 2.2% or less.

Mn: 0.5% to 3.5%

Mn is an element effective for increasing the steel tensile strength and promotes generation of the hard second phase, which includes tempered martensite and bainite. Such effects are exhibited when the Mn content is 0.5% or more. However, when the Mn content exceeds 3.5%, a ferrite fraction falls below 10%, and a hard second phase fraction exceeds 90%, thereby deteriorating the ductility. Therefore, the Mn content is 0.5% or more and 3.5% or less. The lower limit of the Mn content is preferably 1.5% or more. The upper limit of the Mn content is preferably 3.0% or less.

P: 0.003% to 0.100%

P is an element effective for increasing the steel tensile strength, furthermore suppresses the growth of a carbide at a grain boundary, and has effects of improving the low-temperature toughness and further the hole expansion ratio. Such effects are exhibited when the P content is 0.003% or more. However, when the P content exceeds 0.100%, grain boundary segregation causes embrittlement, thereby deteriorating the low-temperature toughness. Therefore, the P content is 0.003% or more and 0.100% or less.

S: 0.02% or Less

S forms an inclusion, such as MnS, and causes a decrease in the hole expansion ratio. Furthermore, S consumes Mn, which promotes generation of the hard second phase, thereby decreasing the hard second phase fraction. Thus, the S content is preferably decreased as much as possible. Thus, S is not necessarily included (may be 0%). Typically, the S content is 0.0001% or more. The S content is preferably 0.0002% or more and more preferably 0.0003% or more. When the S content is 0.02% or less, the Mn content is secured which makes the hard second phase to be 30% or more, thereby obtaining a steel having a tensile strength of 590 MPa or more. Therefore, the S content is 0.02% or less. The upper limit of the S content is more preferably 0.01% or less.

Al: 0.010% to 1.5%

Al works as a deoxidizer and thus is an element effective for cleanliness of the steel, thereby improving the ductility and the hole expansion ratio. Therefore, Al is preferably added in a deoxidizing step. Such an effect is exhibited when the Al content is 0.010% or more. On the other hand, when Al is added in a large amount, the amount of a decarburized layer is increased, and a tensile strength of 590 MPa or more cannot be achieved. Therefore, the upper limit of the Al content is 1.5%.

N: 0.01% or less

N forms nitrides and causes deterioration of the ductility and the hole expansion ratio. Thus, the N content is preferably decreased as much as possible. Therefore, N is not necessarily included (may be 0%). Typically, the N content is 0.0001% or more. When the N content is 0.01% or less, the amount of coarse nitrides decreases and the hole expansion ratio improves. Therefore, the N content is 0.01% or less.

The balance is Fe and unavoidable impurities. In addition to these component elements, the following alloying elements may be added, if necessary. When the contents of the following optional additional elements are below the lower limits, these components do not reduce the effects of the present invention. Therefore, the components are regarded to be included as unavoidable impurities.

One or two or more selected from Cr: 0.005% to 2.00%, Mo: 0.005% to 2.00%, V: 0.005% to 2.00%, Ni: 0.005% to 2.00%, and Cu: 0.005% to 2.00%

When cooling is performed from the annealing temperature, Cr, Mo, V, Ni, and Cu suppress the generation of the ferrite phase and pearlite and promote the generation of the hard second phase, thereby increasing the steel tensile strength. Such effects are exhibited when the content of at least one of Cr, Mo, V, Ni, and Cu is 0.005% or more. However, when component contents of Cr, Mo, V, Ni, and Cu individually exceed 2.00%, the effects are saturated. When the component content exceeds 2.00%, an alloy carbide is formed, and the average equivalent-circle diameter of the carbide at the interface between the ferrite phase and the hard second phase exceeds 200 nm, thereby deteriorating the hole expansion ratio and the low-temperature toughness. Therefore, when these components are added, each content of Cr, Mo, V, Ni, and Cu is 0.005% or more and 2.00% or less. The lower limit of the Cr content is preferably 0.05% or more. The lower limit of the Mo content is preferably 0.02% or more. The lower limit of the V content is preferably 0.02% or more. The lower limit of the Ni content is preferably 0.05% or more. The lower limit of the Cu content is preferably 0.05% or more. The upper limit of each content of Cr, Mo, V, Ni, and Cu is preferably 0.50% or less.

One or two selected from Ti: 0.01% to 0.20% and Nb: 0.01% to 0.20%

Ti and Nb form a carbide and are elements effective for increasing the steel tensile strength by causing precipitation hardening. Such an effect is exhibited when the content is 0.01% or more. On the other hand, when the contents of Ti and Nb individually exceed 0.20%, the carbide is coarsened, thereby deteriorating the hole expansion ratio and the low-temperature toughness. Therefore, when these components are added, the contents of Ti and Nb are individually 0.01% or more and 0.20% or less. The lower limit of the contents of Ti and Nb is preferably 0.02% or more. The upper limit of the contents of Ti and Nb is preferably 0.05% or less.

B: 0.0002% to 0.01%

B suppresses generation of the ferrite phase from the grain boundaries of the austere phase and increases the strength, and also suppresses the growth of the carbide at the grain boundaries and improves the hole expansion ratio and the low-temperature toughness. Such effects are exhibited when the B content is 0.0002% or more. On the other hand, when the B content exceeds 0.01%, $Fe_2B$ is precipitated at prior austenite grain boundaries, and thus embrittlement is caused, thereby deteriorating the low-temperature toughness. Therefore, when B is added, the B content is 0.0002% or more and 0.01% or less. The lower limit of the B content is preferably 0.0005% or more. The upper limit of the B content is preferably 0.0050% or less.

Sb: 0.001% to 0.05%, Sn: 0.001% to 0.05%

Sb and Sn suppress the growth of the carbide at the grain boundaries and thus increase the low-temperature toughness and further the hole expansion ratio. The effect is exhibited when the content is 0.001% or more. On the other hand, when the contents of the elements individually exceed 0.05%, grain boundary segregation causes embrittlement, thereby deteriorating the low-temperature toughness. Therefore, when Sb and Sn are added, the contents of Sb and Sn are individually 0.001% or more and 0.05% or less. The lower limit of the contents of Sb and Sn is preferably 0.015% or more. The upper limit of the contents of Sb and Sn is preferably 0.04% or less.

Subsequently, the steel microstructure of the steel sheet will be described. The steel microstructure includes a ferrite phase with an area fraction of 10% to 70% and a hard second phase with an area fraction of 30% to 90%, and a carbide present at the interface between the ferrite phase and the hard second phase have an average equivalent-circle diameter of 200 nm or less.

Area Fraction of Ferrite Phase: 10% to 70%

If the area fraction of the ferrite phase falls below 10%, the ductility deteriorates. Therefore, the area fraction of the ferrite phase is 10% or more. If the area fraction of the ferrite phase exceeds 70%, the tensile strength deteriorates. Therefore, the area fraction of the ferrite phase is 70% or less. The lower limit of the amount of ferrite is preferably 20% or more. The upper limit of the amount of ferrite is preferably 60% or less. The area fractions are measured by methods described in Example.

Area Fraction of Hard Second Phase: 30% to 90%

If the area fraction of the hard second phase falls below 30%, the tensile strength deteriorates. Therefore, the area fraction of the hard second phase is 30% or more. If the area fraction of the hard second phase exceeds 90%, the ductility deteriorates. Therefore, the area fraction of the hard second phase is 90% or less. The hard second phase includes bainite, tempered martensite, as-quenched martensite, retained austere, and pearlite. The area fraction of the hard second phase refers to the sum of the area fractions of these phases. The area fraction of the hard second phase and the ferrite phase is preferably 95% or more in total.

Hereinafter, the preferable range of the hard second phase will be described. When the following hard second phase includes the following phases, a phase satisfying its condition provides the following effects. When all conditions are satisfied, stretch flangeability tends to become excellent. The following area fraction of the hard second phase is an area fraction relative to the area of the whole microstructure, which is taken as 100%.

Total Area Fraction of Bainite and Tempered Martensite: 10% to 90%

The bainite and the tempered martensite increase the steel tensile strength. The hardness difference between these microstructures and the ferrite phase is smaller than that between the as-quenched martensite and the ferrite phase, and thus an adverse effect on the hole expansion ratio is small. Thus, the bainite and the tempered martensite are phases effective for securing the tensile strength without considerably decreasing the hole expansion ratio. If the bainite and the tempered martensite have an area fraction of less than 10%, it may be difficult to secure a high tensile strength. On the other hand, if the bainite and the tempered martensite have an area fraction of more than 90%, the ductility may deteriorate. Therefore, the total area fraction of the bainite and the tempered martensite is 10% or more and 90% or less. The lower limit of the total area fraction is preferably 15% or more and more preferably 20% or more. The upper limit of the total area fraction is preferably 80% or less and more preferably 70% or less. The area fractions are measured by methods described in Example.

Area Fraction of As-Quenched Martensite: 10% or Less

The as-quenched martensite works effectively for increasing the steel tensile strength. However, the hardness difference between the as-quenched martensite and the ferrite phase is large, and thus when the as-quenched martensite is present excessively in an area fraction of more than 10%, the number of void generation sites increases and the hole expansion ratio decreases. Therefore, the area fraction of the as-quenched martensite is 10% or less, preferably 8% or less. Even if the as-quenched martensite is not included and its area fraction is 0%, the effects of the present invention are not affected and no problem is caused. The area fractions are measured by methods described in Example.

Area Fraction of Retained Austere: 10% or Less

The retained austere not only contributes to an increase in the steel tensile strength, but also works effectively for an improvement in the steel ductility. To obtain such effects, the content of the retained austere is preferably 1% or more and more preferably 2% or more. However, when punching is performed in a hole expanding test, the retained austere close to the edge is induced by a strain to transform into martensite. The hardness difference between the martensite and the ferrite phase is large, and thus if the retained austere is present excessively and its area fraction exceeds 10%, the number of void generation sites increases and the hole expansion ratio decreases. Therefore, the retained austere phase has an area fraction of 10% or less, preferably 8% or less. From the viewpoint of improving the hole expansion ratio, the retained austere preferably has an area fraction of less than 5%. Even if the retained austenite is not included and its area fraction is 0%, the effects of the present invention are not affected and no problem is caused. A volume fraction measured by a method described in Example is regarded as an area fraction and used for the area fraction.

Area Fraction of Pearlite: 3% or Less

Pearlite may be included as a phase other than the ferrite phase, the bainite, the tempered martensite, the as-quenched martensite, and the retained austere. When the steel microstructure of the steel sheet satisfies the above, the object of the present invention is achieved. However, if the pearlite is present excessively in an area fraction of more than 3%, the number of void generation sites increases and the hole expansion ratio decreases. Therefore, the area fraction of the pearlite is 3% or less, preferably 1% or less. Even if the pearlite is not included and has an area fraction of 0%, the effects of the present invention are not affected and no problem is caused. The area fractions are measured by methods described in Example.

Figure 2:
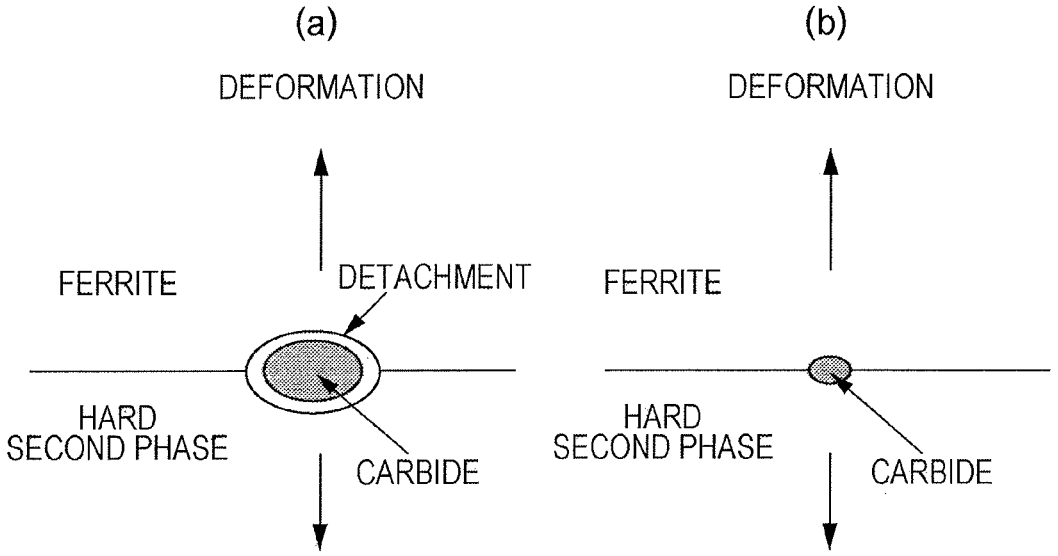
FIG. 2 is a schematic illustration of an initiation behavior of a void during deformation at a low temperature.

Average Equivalent-Circle Diameter of Carbide (Cementite) Present at Interface between Ferrite Phase and Hard Second Phase: 200 nm or Less When the hardness difference between the ferrite phase and the hard second phase increases, because of the difference in the deformability of the two phases in punching the steel sheet or in extending a hole in the steel sheet, voids are generated at the interface between a soft phase and a hard phase, and accordingly the hole expansion ratio may decrease. Thus, it is known that the martensite and the bainite, which are individually the hard second phase, are tempered to decrease the hardness difference and thus, the hole expansion ratio is known to be improved. However, even if the hardness difference is the same, when a coarse carbide that has been precipitated during the tempering is present at the interface between the ferrite phase and the hard second phase, stress concentrates on the coarse carbide, and void generation is promoted in deformation as shown in FIG. 1, thereby decreasing the hole expansion ratio (FIG. 1(*a*)). When the carbide present at the interface between the ferrite phase and the hard second phase has an average equivalent-circle diameter of 200 nm or less, stress concentration in deformation is suppressed and the hole expansion ratio improves (FIG. 1(*b*)). Furthermore, the carbide that is present at the interface between the ferrite phase and the hard second phase and that has an average equivalent-circle diameter of 200 nm or less has an effect of improving the low-temperature toughness. In deformation at low temperature, the carbide particles present at the interface between the ferrite phase and the hard second phase are detached at the interface with the ferrite phase and the hard second phase as shown in FIG. 2, thereby inducing cleavage of the ferrite phase or the hard second phase and promoting brittle fracture (FIG. 2(*a*)). Thus, the carbide present at the interface between the ferrite phase and the hard second phase has an average equivalent-circle diameter of 200 nm or less, thereby suppressing the detachment of the carbide particles at the interface with the ferrite phase and the hard second phase and improving the low-temperature toughness (FIG. 2(*b*)). When the carbide present at the interface between the ferrite phase and the hard second phase has a shorter equivalent-circle diameter, the hole expansion ratio and the low-temperature toughness are more effectively improved. Therefore the carbide has an average equivalent-circle diameter of 200 nm or less. The average equivalent-circle diameter is preferably 100 nm or less, and most preferably the carbide is not present. In addition to iron carbide such as cementite, the carbide may include an alloy carbide including Cr, Mo, V, Ti, Nb, or the like. The average equivalent-circle diameters are measured by methods described in Example. After mechanically polishing a steel sheet in a direction parallel to the sheet surface to a position of ¼t (total thickness t) in a sheet thickness direction, revealing the steel sheet microstructure by electropolishing and capturing, by using a TEM (transmission electron microscope), an image of an extraction replica to which projections and depressions on the surface are transferred by using an evaporated carbon film are performed. In the image of the microstructure, a strip-formed portion that is present between the ferrite phase and the hard second phase and that has a contrast different from the ferrite and hard second phases is the interface between the ferrite phase and the hard second phase (see FIG. 3). The hard second and ferrite phases revealed by electropolishing differ from each other in height on the steel sheet, and thus the sloping portion between the two phases is the interface, which corresponds to the strip-formed portion in the TEM image of the extraction replica. The expression "present at the interface" means that the carbide is at least in contact with the interface, which seems like a strip in the image of the microstructure.

A galvanizing layer may be formed on the surface of the steel sheet. Subsequently, the galvanizing layer will be described. In a galvanized steel sheet (GI) that has not been subjected to alloying treatment, Fe % of the galvanizing layer is preferably 3 mass % or less. In an galvannealed steel sheet (GA) that has been subjected to alloying treatment, Fe % of the galvanizing layer is preferably 7 mass % to 15 mass %.

<Method for Producing High Strength Steel Sheet>

The producing method according to an embodiment of the present invention includes a hot-rolling step, an pickling step, a cold-rolling step, and an annealing step.

The hot-rolling step is a step of rolling a slab having the above composition at a finishing temperature that is the $Ar_3$ transformation temperature or higher, then performing cooling at an average cooling rate of 20° C./s or higher, and performing coiling at 550° C. or lower. The $Ar_3$ transformation temperature was measured by using a formaster.

The steel adjusted to have the above composition is smelted, for example, in a converter and formed into slab by a continuous casting process or the like. The slab to be used is preferably produced by a continuous casting process to prevent the macrosegregation of the components. The slab to be used may be produced by an ingot-making method or a thin slab casting process. Alternatively, after a slab is produced, in addition to a conventional method in which a slab is once cooled to a room temperature and then heated again, an energy saving process, such as hot direct rolling or direct rolling, which includes placing a slab into a heating furnace while keeping the slab temperature without cooling to a room temperature, or performing rolling immediately after keeping the temperature for a short time, may be applied without any problem.

Slab Heating Temperature: 1100° C. or Higher (Suitable Condition)

A slab used in the hot-rolling step may be heated. In heating, a slab heating temperature is preferably low in terms of energy saving. If the heating temperature falls below 1100° C., the carbide is not sufficiently dissolved, and thus even after continuous annealing, carbide having an average equivalent-circle diameter of more than 200 nm remains at the interface between the ferrite phase and the hard second phase, thereby decreasing the hole expansion ratio and the low-temperature toughness. In terms of an increase in the scale loss with increasing oxidation weight gains, the slab heating temperature is desirably 1300° C. or lower. Even when the slab heating temperature is lowered, from the viewpoint of preventing problems in hot rolling, a so-called sheet bar heater may be used, in which a sheet bar is heated.

Finishing Temperature: $Ar_3$ Temperature ($Ar_3$ Transformation Temperature) or Higher If the finishing temperature falls below the $Ar_3$ temperature, $\alpha$ and $\gamma$ are generated in the rolling, and thus pearlite is generated in the subsequent cooling and coiling treatments. Cementite included in the pearlite does not dissolve and remains even after retaining in a temperature range of 750° C. to 900° C. in the following annealing step. As a result, cementite present at the interface between the ferrite phase and the hard second phase has a particle length of more than 200 nm, thereby decreasing the hole expansion ratio and the low-temperature toughness. Therefore, the finishing temperature is the $Ar_3$ temperature or higher. The upper limit of the finishing temperature is not particularly limited; however, the upper limit is preferably 1000° C. or lower because performing the following cooling to a coiling temperature becomes difficult. Here, the $Ar_3$ temperature is a temperature at which ferrite transformation starts in the cooling.

Average Cooling Rate: 20° C./s or More

The average cooling rate after the finish rolling is 20° C./s or more, so that the microstructure of the hot-rolled steel sheet includes bainite as a main component and becomes a uniform microstructure, and thus the cementite is less likely to be generated. As a result, finally, the carbide at the interface between the ferrite phase and the hard second phase have an average equivalent-circle diameter of 200 nm or less, thereby improving the hole expansion ratio and the low-temperature toughness. If the average cooling rate falls below 20° C./s, pearlite is generated in the steel, and cementite included in the pearlite does not dissolve and remains even after retaining in a temperature range of 750° C. to 900° C. As a result, a carbide present at the interface between the ferrite phase and the hard second phase has a particle length of more than 200 nm, thereby decreasing the hole expansion ratio and the low-temperature toughness. Therefore, the average cooling rate is 20° C./s or more. The upper limit of the average cooling rate is not particularly limited; however, the upper limit is preferably 50° C./s or less because performing cooling to 550° C. or lower by the time coiling starts becomes difficult.

Coiling Temperature: 550° C. or Lower

The coiling temperature is 550° C. or lower, and thus the microstructure of the hot-rolled steel sheet includes bainite as a main component and becomes a uniform microstructure, and thus the cementite is less likely to be generated. As a result, finally, the carbide present at the interface between the ferrite phase and the hard second phase has an average equivalent-circle diameter of 200 nm or lower, thereby improving the hole expansion ratio and the low-temperature toughness. If the coiling temperature exceeds 550° C., pearlite is generated in the steel, and cementite included in the pearlite does not dissolve and remains even after the retaining in the temperature range of 750° C. to 900° C. As a result, cementite present at the interface between the ferrite phase and the hard second phase has a particle length of more than 200 nm, thereby decreasing the hole expansion ratio and the low-temperature toughness. Therefore, the coiling temperature is 550° C. or lower. If the coiling temperature falls below 300° C., controlling the coiling temperature is difficult and temperature unevenness is likely to occur, thereby causing a problem, such as a decrease in the cold rolling properties. Therefore, the coiling temperature is preferably 300° C. or higher. Even if the coiling temperature is controlled in this range, the cementite may remain in the hot-rolled steel sheet; however, the remaining cementite can be dissolved in the austere phase in the following retaining in the temperature range of 750° C. to 900° C.

In the hot rolling in the present invention, to decrease a rolling load in the hot rolling, the finish rolling may be partly or totally a lubricated rolling. The lubricated rolling is effective in terms of the uniformity of the steel sheet form and the materials. In the lubricated rolling, the friction coefficient is preferably in the range of 0.25 to 0.10. This process is preferably a continuous rolling process in which sheet bars adjacent to each other in line are joined and subjected to continuous finish rolling are performed. Applying the continuous rolling process is desirable in terms of operational stability in the hot rolling.

Next, the pickling step is performed. The pickling step is a step of removing an oxide scale of a surface of a hot-rolled steel sheet obtained in the hot-rolling step by performing pickling. The acid washing conditions are not particularly limited and may be specified appropriately.

Next, the cold-rolling step is performed. The cold-rolling step is a step of cold-rolling a pickled sheet after the pickling step. The cold-rolling conditions are not particularly limited, and conditions, such as rolling reduction, may be determined from the viewpoint of, for example, desired sheet thickness. In the present invention, the rolling reduction in the cold rolling is preferably 30% or more.

Next, the annealing step is performed. The annealing step is a step of heating a cold-rolled steel sheet obtained in the cold-rolling step to a temperature of 750° C. to 900° C. while heating the steel sheet at an average heating rate of 10° C./s or more in a temperature range of 500° C. to the $Ac_1$ transformation temperature and cooling the steel sheet to a temperature lower than or equal to (Ms temperature—100° C.) while cooling the steel sheet at an average cooling rate of 10° C./s or more and to a cooling stop temperature of (Ms temperature—100° C.). A retention time in a temperature range of 750° C. to 900° C. is 10 seconds or more in the heating and the cooling. When the cooling stop temperature falls below 150° C., after the cooling is performed to a temperature lower than or equal to (Ms temperature—100° C.), the steel sheet is heated at an average heating rate of 30° C./s or more to a temperature of 150° C. or higher and 350° C. or lower and retained in a temperature range of 150° C. or higher and 350° C. or lower for 10 seconds or more and 600 seconds or less. When the cooling stop temperature is 150° C. or higher, after the cooling is performed to a temperature lower than or equal to (Ms temperature—100° C.), the steel sheet is heated at an average heating rate of 30° C./s or more to a temperature of 150° C. or higher and 350° C. or lower and retained in a temperature range of 150° C. or higher and 350° C. or lower for 10 seconds or more and 600 seconds or less, or after the cooling is performed to a temperature lower than or equal to (Ms temperature—100° C.), the steel sheet is retained in a temperature range of 150° C. or higher and 350° C. or lower for 10 seconds or more and 600 seconds or less. The $Ac_1$ transformation temperature was measured by the Formaster test.

Average Heating Rate in Temperature Range of 500° C. to $Ac_1$ Transformation Temperature: 10° C./s or More In the steel in the present invention, the average heating rate is 10° C./s or more in a recrystallization temperature range of 500° C. to the $Ac_1$ transformation temperature, and thus ferrite recrystallization during heating is suppressed and γ (austere) generated at the $Ac_1$ transformation temperature or higher is made finer, thereby increasing the area of the interface between the ferrite phase and the hard second phase. This increases the number of carbide generation sites, and the carbide has an average equivalent-circle diameter of 200 nm or less, thereby improving the hole expansion ratio and the low-temperature toughness. If the average heating rate falls below 10° C./s, recrystallization of the ferrite phase proceeds during heating, γ generated at the $Ac_1$ transformation temperature or higher is coarsened, and the interface between the ferrite phase and the hard second phase decreases, thereby decreasing the carbide generation sites. As a result, the carbide has an average equivalent-circle diameter of more than 200 nm, and the hole expansion ratio and the low-temperature toughness decrease. The preferable average heating rate is 20° C./s or more. The upper limit of the average heating rate is not particularly limited. When the average heating rate is 100° C./s or more, the effects are saturated and furthermore the cost increases. Accordingly, 100° C./s or less is preferable. The $Ac_1$ is a temperature at which austere starts to be generated in heating.

Heating Temperature: 750° C. to 900° C.

If the heating temperature falls below 750° C., the austere phase is not sufficiently generated in the annealing, and thus a sufficient amount of the hard second phase is not secured after the annealing, thereby decreasing the strength. In addition, if the heating temperature falls below 750° C., the cementite remaining in the steel is not caused to dissolve in the austere phase. Accordingly, the cementite at the interface between the ferrite phase and the hard second phase has an average equivalent-circle diameter of more than 200 nm. As a result, fracture occurs from this cementite, and the hole expansion ratio and the low-temperature toughness decrease. In contrast, if the heating temperature exceeds 900° C., the amount of the ferrite phase becomes less than 10%, thereby decreasing ductility. Therefore, the heating temperature is in the range of 750° C. to 900° C. The average heating rate from the $Ac_1$ transformation temperature to the above heating temperature is not particularly limited; however, the average heating rate may be about 5° C./s or less.

Average Cooling Rate to Temperature of (Ms temperature—100° C.): 10° C./s or More If the average cooling rate to a temperature of (Ms temperature—100° C.) falls below 10° C./s, the ferrite phase and the pearlite are generated, thereby decreasing the tensile strength, the ductility, and the hole expansion ratio. The upper limit of the average cooling rate is not particularly specified; however, if the average cooling rate is excessively high, a steel-sheet form is degraded or the control of the cooling stop temperature becomes difficult. Therefore, the average cooling rate is preferably 200° C./s or less. The cooling start temperature is not particularly limited. Normally, it is sufficient that the cooling is started typically at 750° C., which is the above heating temperature.

Cooling Stop Temperature: (Ms Temperature—100° C.) or Lower

When the cooling stops, the austere phase partly transforms into martensite and bainite, and the remaining austere phase becomes an untransformed austere phase. Due to the subsequent retaining performed at the cooling stop temperature or in the temperature range of 150° C. to 350° C., or due to the cooling performed to a room temperature after the coating or alloying treatment, the martensite becomes tempered martensite, the bainite is tempered, and the untransformed austenite phase becomes bainite, retained austenite, or as-quenched martensite. When the cooling stop temperature is low and the difference between the cooling stop temperature and Ms temperature (Ms temperature: the temperature at which martensite transformation of austenite starts) is larger, the amount of martensite generated in the cooling increases and the amount of untransformed austenite decreases. Accordingly, the control of the cooling stop temperature relates to the final area fraction of as-quenched martensite and retained austenite and to the final area fraction of bainite and tempered martensite. Thus, the temperature difference between Ms temperature and the cooling stop temperature is important. Accordingly, the Ms temperature is used as an index of the control of the cooling stop temperature. When the cooling stop temperature is equal to or lower than (Ms temperature—100° C.), martensite transformation proceeds sufficiently in the cooling, and thus the final area fraction of the bainite and the tempered martensite equals 30% to 90%, thereby improving the hole expansion ratio. If the cooling stop temperature is higher than (Ms temperature—100° C.), the martensite transformation is insufficient when the cooling stops, which increases in the amount of untransformed austenite and generates more than 10% of as-quenched martensite or retained austenite in the end, thereby decreasing the hole expansion ratio. Therefore, the cooling stop temperature is a temperature lower than or equal to (Ms temperature—100° C.). The lower limit of the cooling stop temperature is not particularly specified. If the cooling stop temperature falls below (Ms temperature—200° C.), the martensite transformation is almost finished in the cooling. Thus, retained austenite is not eventually obtained, and the improvement in ductility due to TRIP effect is not expected. Therefore, the cooling stop temperature is preferably higher than or equal to (Ms temperature—200° C.). The Ms temperature can be determined by measuring a volume change in the steel sheet during the cooling in the annealing and determining a change in the coefficient of linear expansion. The Ms temperature varies depending on the annealing temperature and the cooling rate, and thus the Ms temperature is measured at each condition.

Retention Time: 10 Seconds or More

If the retention time at 750° C. to 900° C. falls below 10 seconds in the heating and the cooling, the austenite phase is not sufficiently generated in the annealing, and thus the amount of the hard second phase is not sufficiently secured during the cooling in the annealing. In addition, if the retention time falls below 10 seconds, the cementite remaining in the steel is not caused to dissolve in the austenite phase. Accordingly, the cementite at the interface between the ferrite phase and the hard second phase has an average equivalent-circle diameter of more than 200 nm. Fracture occurs from this cementite, and the hole expansion ratio and the low-temperature toughness decrease. Therefore, the retention time is 10 seconds or more. The upper limit of the retention time is not particularly specified; however, if the retention time is 600 seconds or more, the effects are saturated. Therefore, the retention time is preferably less than 600 seconds.

Manufacturing conditions after the cooling in which the cooling stop temperature is below 150° C. and manufacturing conditions after the cooling in which the cooling stop temperature is 150° C. or higher will be described separately. When the cooling stop temperature falls below 150° C., after the cooling is performed to a temperature lower than or equal to (Ms temperature—100° C.), the steel sheet is heated at an average heating rate of 30° C./s or more to a temperature of 150° C. or higher and 350° C. or lower and retained in a temperature range of 150° C. or higher and 350° C. or lower for 10 seconds or more and 600 seconds or less. When the cooling stop temperature is 150° C. or higher, after the cooling is performed to a temperature lower than or equal to (Ms temperature—100° C.), the steel sheet is heated at an average heating rate of 30° C./s or more to a temperature of 150° C. or higher and 350° C. or lower and retained in a temperature range of 150° C. or higher and 350° C. or lower for 10 seconds or more and 600 seconds or less, or after the cooling is performed to a temperature lower than or equal to (Ms temperature—100° C.), the steel sheet is retained in a temperature range of 150° C. or higher and 350° C. or lower for 10 seconds or more and 600 seconds or less. Each condition will be described as follows.

Average Heating Rate after Cooling: 30° C./s or More

What is important is that after the cooling, retaining is performed in a temperature range of 150° C. to 350° C. for a certain time to temper the martensite and bainite generated in the cooling. In re-heating, if the average heating rate to the temperature range falls below 30° C./s, a carbide is precipitated at the interface between the ferrite phase and the hard second phase in heating, promoted to grow in the subsequent retaining, and finally has an average equivalent-circle diameter of more than 200 nm at the interface between the ferrite phase and the hard second phase, thereby decreasing the hole expanding properties and the low-temperature toughness. When the average heating rate is 30° C./s or more, a carbide is not precipitated at the interface between the ferrite phase and the hard second phase in heating and finally has an average equivalent-circle diameter of 200 nm or less at the interface between the ferrite phase and the hard second phase, thereby improving the hole expansion ratio and the low-temperature toughness. Therefore, the average heating rate is 30° C./s or more in re-heating after the cooling stops. The upper limit of the average heating rate is not particularly limited; however, 200° C./s or less is preferable because the control of the re-heating temperature in a temperature range of 150° C. to 350° C. is difficult. The re-heating is optional as described above. When the cooling stop temperature is in the temperature range of 150° C. to 350° C., retaining can be performed in the temperature range without re-heating, and thus the growth of the carbide is suppressed, and the hole expanding properties and the low-temperature toughness improve.

Retaining in Temperature Range of 150° C. to 350° C.

After cooling is performed to a temperature lower than or equal to (Ms temperature—100° C.), the steel sheet is retained in the temperature range of 150° C. to 350° C. In the retaining or the subsequent coating and alloying treatments, the martensite generated in the cooling becomes tempered martensite, bainite is tempered, and bainite transformation of untransformed γ partly occurs. The difference between the hardness of the bainite and the tempered martensite and that of the ferrite phase is small, and thus the hole expansion ratio improves. In addition, in the retaining in the temperature range of 150° C. to 350° C. and in the subsequent coating and alloying, a carbide is precipitated with tempering. If the lower limit of the temperature range falls below 150° C., the martensite is insufficiently tempered and the hardness difference from the ferrite phase becomes large, thereby decreasing the hole expansion ratio. In contrast, if the upper limit of the temperature range exceeds 350° C., a carbide is coarsened with tempering, and the carbide at the interface between the ferrite phase and the hard second phase has an average equivalent-circle diameter of more than 200 nm, thereby decreasing the hole expansion ratio and the low-temperature toughness. Therefore, the retaining is performed in the temperature range of 150° C. to 350° C. The technical significance of the present conditions is the same regardless of whether the cooling stop temperature is lower than 150° C. or 150° C. or higher.

Retention Time in Temperature Range of 150° C. to 350° C.: 10 to 600 Seconds

If the retention time falls below 10 seconds, the martensite is tempered insufficiently and the hardness difference from the ferrite phase increases, thereby decreasing the hole expansion ratio. Therefore, from the viewpoint of stretch flangeability, the retention time is preferably 10 seconds or more. In contrast, if the retention time exceeds 600 seconds, a carbide at the interface between the ferrite phase and the hard second phase is coarsened and has an average equivalent-circle diameter of more than 200 nm, thereby decreasing the hole expansion ratio and the low-temperature toughness. Therefore, the retention time is 600 seconds or less. The lower limit is preferably 20 seconds or more. The upper limit is preferably 500 seconds or less. The technical significance of the present conditions is the same regardless of whether the cooling stop temperature is lower than 150° C. or 150° C. or higher.

When a galvanizing layer is formed on the steel sheet surface, after the annealing step, a galvanizing step of heating an annealed sheet at an average heating rate of 30° C./s or more to a sheet temperature at which the sheet is immersed in a hot-dip galvanizing bath and performing hot-dip galvanizing is further performed.

In the coating treatment, conditions other than the following average heating rate are not particularly limited. For example, in producing a galvanized steel sheet, the steel sheet is immersed in a coating bath containing 0.12 mass % to 0.22 mass % of dissolved Al, and in producing a galvannealed steel sheet, the steel sheet is immersed in a coating bath containing 0.12% to 0.17 mass % of dissolved Al, (bath temperature 440° C. to 500° C.), and the coating weight is adjusted by, for example, gas wiping. In the galvannealing treatment, after the coating weight is adjusted, heating is performed at the following average heating rate to a temperature of 500° C. to 570° C., and retaining is performed for 30 seconds or less.

Average Heating Rate to Sheet Temperature at which Sheet is Immersed in Hot-Dip Galvanizing Bath: 30° C./s or More If the average heating rate to the sheet temperature at which the sheet is immersed in a hot-dip galvanizing bath (typically 440° C. to 500° C.) falls below 30° C./s, a carbide is precipitated at the interface between the ferrite phase and the hard second phase in heating. In the subsequent galvanizing bath immersion, the carbide is promoted to grow, and eventually the carbide at the interface between the ferrite phase and the hard second phase has an average equivalent-circle diameter of more than 200 nm, thereby decreasing the hole expanding properties and the low-temperature toughness. When the average heating rate is 30° C./s or more, a carbide is not precipitated at the interface between the ferrite phase in the interface and the hard second phase in heating. Finally, a carbide at the interface between the ferrite and hard second phases in the microstructure has an equivalent-circle diameter of 200 nm or less, thereby improving the hole expansion ratio and the low-temperature toughness.

Average Heating Rate to Temperature Range of 500° C. to 570° C. is 30° C./s or More When the alloying treatment is performed, if the average heating rate to the temperature range of 500° C. to 570° C., which is the heating temperature of the alloying treatment, falls below 30° C./s, a carbide is precipitated at the interface between the ferrite phase and the hard second phase in the heating and promoted to grow in the subsequent alloying treatment. The carbide at the interface between the ferrite phase and the hard second phase finally has an average equivalent-circle diameter of more than 200 nm, thereby decreasing the hole expanding properties and the low-temperature toughness. When the average heating rate is 30° C./s or more, a carbide is not precipitated at the interface between the ferrite phase and the hard second phase in heating and the carbide at the interface between the ferrite phase and the hard second phase finally has an equivalent-circle diameter of 200 nm or less, thereby improving the hole expansion ratio and the low-temperature toughness.

Retention Time in Temperature Range of 500° C. to 570° C. is 30 Seconds or Less

If the retention time in the temperature range of 500° C. to 570° C. exceeds 30 seconds, the carbide at the interface between the ferrite phase and the hard second phase has an equivalent-circle diameter of more than 200 nm, thereby decreasing the hole expanding properties and the low-temperature toughness. Therefore, the retention time is 30 seconds or less. The lower limit of the retention time is not particularly limited; however, if the retention time is less than one second, alloying is difficult. Therefore, one second or more is preferable.

After the heat treatment, temper rolling may be further performed on the cold-rolled steel sheet, the galvanized steel sheet, or the galvannealed steel sheet for, for example, the form correction or the surface roughness adjustment. There is no problem in performing various coating treatments, such as resin coating or oil and fat coating.

EXAMPLES

A steel having a composition shown in Table 1 and the balance being Fe and unavoidable impurities was smelted in a vacuum melting furnace and bloomed to obtain a bloomed material having a thickness of 27 mm. The resulting bloomed material was hot-rolled to have a sheet thickness of 3.0 mm. The hot rolling was performed at a slab heating temperature of 1200° C. in the conditions shown in Table 2. Subsequently, the hot-rolled steel sheet was pickled and then cold-rolled to have a sheet thickness of 1.4 mm to produce a cold-rolled steel sheet. Next, the resulting cold-rolled steel sheet was heat-treated in the conditions shown in Table 2 to obtain a high strength steel sheet (CR). Then, some of the high strength steel sheets were individually subjected to hot-dip galvanizing at 460° C. to obtain a galvanized steel sheet (GI). Furthermore, some of the steel sheets were individually subjected to heat treatment (annealing) shown in Table 2, subjected to hot-dip galvanizing at 460° C., and then subjected to alloying treatment at 520° C. to obtain an galvannealed steel sheet (GA). The coating weight per surface was 35 to 45 g/m$^2$. In Table 2, examples in which the cooling stop temperature and the heating temperature applied after the cooling stops are the same are examples that were retained after the cooling stops.

TABLE 1

| Steel | C | Si | Mn | P | S | sol. Al | N | Cr | Mo | V | Ni | Cu | Ti | Nb | B | Sb | Sn | mass % |
|---|---|---|---|---|---|---|---|---|---|---|---|---|---|---|---|---|---|---|
| A | 0.06 | 1.3 | 2.3 | 0.023 | 0.005 | 0.036 | 0.005 | | | | | | | | | | | Invention Example |
| B | 0.08 | 1.2 | 2.6 | 0.021 | 0.004 | 0.022 | 0.006 | | | | | | | | | | | Invention Example |
| C | 0.11 | 1.4 | 1.8 | 0.009 | 0.001 | 0.033 | 0.007 | | | | | | | | | | | Invention Example |
| D | 0.15 | 0.9 | 2.8 | 0.018 | 0.006 | 1.000 | 0.003 | | | | | | | | | | | Invention Example |
| E | 0.21 | 0.6 | 1.5 | 0.025 | 0.003 | 1.300 | 0.003 | | | | | | | | | | | Invention Example |
| F | 0.17 | 1.6 | 1.5 | 0.019 | 0.006 | 0.028 | 0.003 | 0.32 | | | | | | | | | | Invention Example |
| G | 0.13 | 1.5 | 3.2 | 0.021 | 0.007 | 0.044 | 0.006 | | 0.25 | | | | | | | | | Invention Example |
| H | 0.11 | 0.8 | 1.5 | 0.015 | 0.002 | 0.043 | 0.005 | | | 0.08 | | | | | | | | Invention Example |
| I | 0.06 | 1.5 | 2.1 | 0.022 | 0.004 | 0.035 | 0.004 | | | | 0.3 | | | | | | | Invention Example |
| J | 0.17 | 0.6 | 2.7 | 0.013 | 0.004 | 0.042 | 0.004 | | | | | 0.2 | | | | | | Invention Example |
| K | 0.11 | 0.9 | 2.7 | 0.015 | 0.005 | 0.032 | 0.004 | | | | | | 0.05 | | | | | Invention Example |
| L | 0.17 | 0.9 | 1.7 | 0.017 | 0.001 | 0.044 | 0.006 | | | | | | | 0.05 | | | | Invention Example |
| M | 0.14 | 0.9 | 1.8 | 0.008 | 0.002 | 0.018 | 0.001 | | | | | | | | 0.0051 | | | Invention Example |
| N | 0.22 | 1.0 | 2.0 | 0.009 | 0.005 | 0.043 | 0.001 | | 0.08 | | | | | | 0.0022 | | | Invention Example |
| O | 0.11 | 1.3 | 2.6 | 0.024 | 0.006 | 0.021 | 0.004 | | | | | | 0.02 | | 0.0036 | | | Invention Example |
| P | 0.07 | 0.8 | 1.3 | 0.006 | 0.002 | 0.029 | 0.003 | | | | | | | 0.03 | 0.0012 | | | Invention Example |
| Q | 0.13 | 0.9 | 1.6 | 0.017 | 0.004 | 0.023 | 0.007 | | | | | | | | | 0.023 | | Invention Example |
| R | 0.13 | 0.5 | 2.1 | 0.017 | 0.004 | 0.036 | 0.001 | | | | | | | | | | 0.034 | Invention Example |
| S | 0.03 | 0.9 | 1.2 | 0.012 | 0.005 | 0.035 | 0.002 | | | | | | | | | | | Comparative Example |
| T | 0.33 | 0.6 | 1.3 | 0.018 | 0.003 | 0.031 | 0.006 | | | | | | | | | | | Comparative Example |
| U | 0.08 | 0.7 | 3.7 | 0.009 | 0.001 | 0.040 | 0.005 | | | | | | | | | | | Comparative Example |
| V | 0.13 | 1 | 0.2 | 0.013 | 0.005 | 0.029 | 0.005 | | | | | | | | | | | Comparative Example |
| W | 0.18 | 0.7 | 2.2 | 0.012 | 0.003 | 0.043 | 0.006 | | | | 0.3 | | 0.02 | 0.03 | 0.0011 | | | Invention Example |

* Underlined numbers are out of the scope of the present invention.

TABLE 2

| | | Hot rolling | | | | | | | | | |
|---|---|---|---|---|---|---|---|---|---|---|---|
| No. | Steel | $Ar_3$ transformation temperature (° C.) | Finishing temperature (° C.) | Average cooling rate (° C./s) | Coiling temperature (° C.) | $Ac_1$ transformation temperature (° C.) | Average heating rate from 500° C. to $Ac_1$ (° C./s) | Heating temperature (° C.) | Retention time in temperature range of 750° C. to 900° C. (s) | Average cooling rate (° C./s) | Cooling stop temperature (° C.) |
| 1 | A | 867 | 930 | 30 | 450 | 736 | 30 | 820 | 30 | 20 | 200 |
| 2 | A | 867 | 930 | 30 | 450 | 736 | 30 | 820 | 30 | 20 | 200 |
| 3 | A | 867 | *850* | 30 | 450 | 736 | 30 | 820 | 30 | 20 | 200 |
| 4 | A | 867 | 930 | 30 | *650* | 736 | 20 | 820 | 15 | 20 | 210 |
| 5 | A | 867 | 930 | 30 | 450 | 736 | *5* | 820 | 100 | 20 | 180 |
| 6 | A | 867 | 930 | *15* | 400 | 736 | 20 | 800 | 80 | 20 | 180 |
| 7 | A | 867 | 930 | 40 | 400 | 736 | 20 | 800 | 80 | 20 | 180 |
| 8 | A | 867 | 930 | 40 | 450 | 736 | 20 | 800 | 20 | 20 | 220 |
| 9 | A | 867 | 930 | 40 | 450 | 736 | 40 | 800 | 20 | *5* | 180 |
| 10 | A | 867 | 930 | 40 | 450 | 736 | 40 | 820 | 20 | 20 | 180 |
| 11 | B | 844 | 930 | 40 | 500 | 730 | 20 | 840 | 30 | 20 | 180 |
| 12 | B | 844 | 930 | 40 | 500 | 730 | 20 | 840 | 30 | 20 | 180 |
| 13 | B | 844 | 930 | 40 | 450 | 730 | 40 | 850 | *5* | 15 | 220 |
| 14 | B | 844 | 930 | 25 | 450 | 730 | 20 | *930* | 20 | 15 | 220 |
| 15 | B | 844 | 930 | 25 | 450 | 730 | 20 | 840 | 20 | 15 | 220 |
| 16 | C | 859 | 930 | 25 | 450 | 744 | 40 | 830 | 60 | 20 | 200 |
| 17 | C | 859 | 930 | 25 | 450 | 744 | 40 | 830 | 60 | 20 | 200 |
| 18 | C | 859 | 930 | 25 | 450 | 744 | 40 | 830 | 20 | 15 | 140 |
| 19 | C | 859 | 930 | 25 | 450 | 744 | 20 | 800 | 30 | 15 | 170 |
| 20 | D | 882 | 930 | 25 | 500 | 719 | 40 | 820 | 80 | 30 | 180 |
| 21 | D | 882 | 930 | 30 | 500 | 719 | 40 | 820 | 80 | 30 | 180 |
| 22 | D | 882 | 930 | 30 | 450 | 719 | 20 | *730* | 50 | 30 | 150 |
| 23 | E | 901 | 930 | 30 | 450 | 708 | 20 | 840 | 20 | 20 | 220 |
| 24 | E | 901 | 930 | 30 | 450 | 708 | 20 | 840 | 20 | 20 | 220 |

TABLE 2-continued

| | | | | | | | | | | | |
|---|---|---|---|---|---|---|---|---|---|---|---|
| 25 | E | 901 | 930 | 30 | 450 | 708 | 20 | 870 | 20 | 20 | 150 |
| 26 | F | 901 | 930 | 25 | 450 | 760 | 30 | 880 | 60 | 20 | 220 |
| 27 | G | 864 | 930 | 25 | 450 | 752 | 20 | 850 | 20 | 20 | 190 |
| 28 | H | 888 | 930 | 25 | 450 | 732 | 20 | 850 | 20 | 20 | 200 |
| 29 | I | 858 | 930 | 25 | 450 | 739 | 20 | 840 | 70 | 20 | 190 |
| 30 | J | 875 | 930 | 25 | 450 | 712 | 20 | 860 | 20 | 20 | 210 |
| 31 | K | 780 | 930 | 25 | 450 | 722 | 30 | 870 | 30 | 20 | 210 |
| 32 | L | 836 | 930 | 25 | 450 | 731 | 20 | 880 | 50 | 20 | 210 |
| 33 | M | 829 | 930 | 25 | 450 | 731 | 20 | 770 | 20 | 20 | 180 |
| 34 | N | 828 | 930 | 25 | 450 | 730 | 20 | 780 | 30 | 20 | 180 |
| 35 | O | 806 | 930 | 25 | 450 | 741 | 20 | 830 | 40 | 20 | 200 |
| 36 | P | 897 | 930 | 30 | 450 | 733 | 30 | 810 | 20 | 20 | 210 |
| 37 | Q | 858 | 930 | 30 | 450 | 732 | 20 | 820 | 50 | 20 | 200 |
| 38 | R | 841 | 930 | 30 | 450 | 716 | 20 | 860 | 20 | 30 | 230 |
| 39 | S | 811 | 930 | 30 | 450 | 736 | 20 | 830 | 50 | 20 | 200 |
| 40 | T | 889 | 930 | 30 | 450 | 727 | 20 | 830 | 50 | 20 | 200 |
| 41 | U | 796 | 930 | 30 | 450 | 709 | 20 | 830 | 50 | 20 | 200 |
| 42 | V | 796 | 930 | 30 | 450 | 750 | 20 | 830 | 50 | 20 | 200 |
| 43 | W | 805 | 900 | *10* | *600* | 706 | 20 | 780 | 60 | 50 | 220 |
| 44 | W | 805 | 900 | 30 | *600* | 706 | 20 | 780 | 60 | 50 | 220 |
| 45 | W | 805 | 900 | 30 | 500 | 706 | 20 | 780 | 60 | 50 | 220 |
| 46 | W | 805 | 900 | 30 | 500 | 706 | 20 | 780 | 60 | 50 | 220 |
| 47 | W | 805 | 900 | 30 | 500 | 706 | 20 | 780 | 60 | 50 | 220 |
| 48 | W | 805 | 900 | 30 | 500 | 706 | 20 | 780 | 60 | 50 | 220 |
| 49 | B | 844 | 930 | 40 | 500 | 730 | 20 | 840 | 30 | 20 | 180 |

| No. | Ms temperature (° C.) | Average heating rate after cooling stops (° C./s) | Heating temperature after cooling stops (° C.) | Retention time in temperature range of 150° C. to 350° C. (s) | Average heating rate to hot-dip galvanizing bath (° C./s) | Average heating rate to alloying treatment (° C./s) | GI or GA | Retention time in temperature range of alloying treatment (s) | |
|---|---|---|---|---|---|---|---|---|---|
| 1 | 346 | 40 | 250 | 50 | 40 | — | GI | — | I.E. |
| 2 | 346 | 50 | 250 | 50 | 40 | 40 | GA | 20 | I.E. |
| 3 | 346 | 50 | 250 | 50 | 40 | 40 | GA | 10 | C.E. |
| 4 | 361 | 40 | 250 | 20 | 40 | 40 | GA | 20 | C.E. |
| 5 | 322 | 60 | 300 | 30 | — | — | GI | — | C.E. |
| 6 | 322 | 40 | 330 | 50 | 40 | 40 | GA | 20 | C.E. |
| 7 | 322 | 40 | *400* | 50 | 40 | 40 | GA | 10 | C.E. |
| 8 | 322 | 100 | 300 | 100 | 40 | 40 | GA | 20 | I.E. |
| 9 | 322 | 40 | 190 | 300 | 40 | 40 | GA | 10 | C.E. |
| 10 | 346 | 40 | 300 | 100 | 40 | 40 | GA | *40* | C.E. |
| 11 | 352 | 40 | 300 | 50 | 40 | — | GI | — | I.E. |
| 12 | 352 | 40 | 300 | 50 | 40 | 40 | GA | 20 | I.E. |
| 13 | 371 | 30 | 320 | 300 | 40 | 40 | GA | 10 | C.E. |
| 14 | 401 | 40 | 320 | 50 | 40 | 40 | GA | 20 | C.E. |
| 15 | 352 | 40 | 320 | 50 | *20* | — | GI | — | C.E. |
| 16 | 336 | 40 | 250 | 50 | 40 | — | GI | — | I.E. |
| 17 | 336 | — | 200 | 50 | 40 | 40 | GA | 20 | I.E. |
| 18 | 336 | *20* | 330 | 150 | 40 | 40 | GA | 20 | C.E. |
| 19 | 323 | 40 | 300 | *700* | 40 | 40 | GA | 20 | C.E. |
| 20 | 327 | 40 | 200 | 60 | 40 | — | GI | — | I.E. |
| 21 | 327 | 40 | 200 | 60 | 40 | 40 | GA | 20 | I.E. |
| 22 | 300 | 40 | 320 | 30 | 40 | 40 | GA | 10 | C.E. |
| 23 | 351 | — | 220 | 50 | 40 | — | GI | — | I.E. |
| 24 | 351 | — | 220 | 50 | 40 | 40 | GA | 20 | I.E. |
| 25 | 380 | 40 | 220 | 20 | 40 | *10* | GA | 10 | C.E. |
| 26 | 369 | 40 | 250 | 400 | 40 | 40 | GA | 20 | I.E. |
| 27 | 341 | 40 | 250 | 300 | 40 | — | GI | — | I.E. |
| 28 | 343 | — | 200 | 500 | 40 | — | GI | — | I.E. |
| 29 | 335 | 40 | 300 | 50 | 40 | 40 | GA | 20 | I.E. |
| 30 | 361 | 40 | 340 | 60 | 40 | — | GI | — | I.E. |
| 31 | 358 | 40 | 320 | 40 | 40 | 40 | GA | 10 | I.E. |
| 32 | 354 | 40 | 310 | 20 | 40 | 40 | GA | 10 | I.E. |
| 33 | 305 | 40 | 300 | 30 | 40 | — | GI | — | I.E. |
| 34 | 298 | 40 | 300 | 50 | 40 | — | GI | — | I.E. |
| 35 | 351 | 40 | 250 | 40 | 40 | 40 | GA | 10 | I.E. |
| 36 | 361 | 40 | 320 | 400 | 40 | — | GI | — | I.E. |
| 37 | 352 | 40 | 280 | 200 | 40 | — | GI | — | I.E. |
| 38 | 368 | 40 | 260 | 200 | 40 | 40 | GA | 20 | I.E. |
| 39 | 379 | 40 | 300 | 100 | 40 | 40 | GA | 10 | C.E. |
| 40 | 302 | 40 | 300 | 100 | 40 | 40 | GA | 10 | C.E. |
| 41 | 312 | 40 | 300 | 100 | 40 | 40 | GA | 20 | C.E. |
| 42 | 375 | 40 | 300 | 100 | 40 | 40 | GA | 20 | C.E. |
| 43 | 355 | *20* | 250 | 30 | *20* | *20* | GA | 10 | C.E. |
| 44 | 355 | *20* | 250 | 30 | *20* | *20* | GA | 10 | C.E. |
| 45 | 355 | *20* | 250 | 30 | *20* | *20* | GA | 10 | C.E. |
| 46 | 355 | 40 | 250 | 30 | *20* | *20* | GA | 10 | C.E. |

TABLE 2-continued

| | | | | | | | | | |
|---|---|---|---|---|---|---|---|---|---|
| 47 | 355 | 40 | 250 | 30 | 40 | *20* | GA | 10 | C.E. |
| 48 | 355 | 40 | 250 | 30 | 40 | 40 | GA | 10 | I.E. |
| 49 | 352 | 40 | 300 | 50 | — | — | CR | — | I.E. |

* Italicized numbers are out of the range of the producing method according to the present invention.
I.E.: Invention Example,
C.E.: Comparative Example The obtained high strength steel sheets were examined in terms of phase fractions of the steel microstructure, tensile properties, the hole expansion ratio, and low-temperature toughness.

Steel Microstructure

Figure 3:
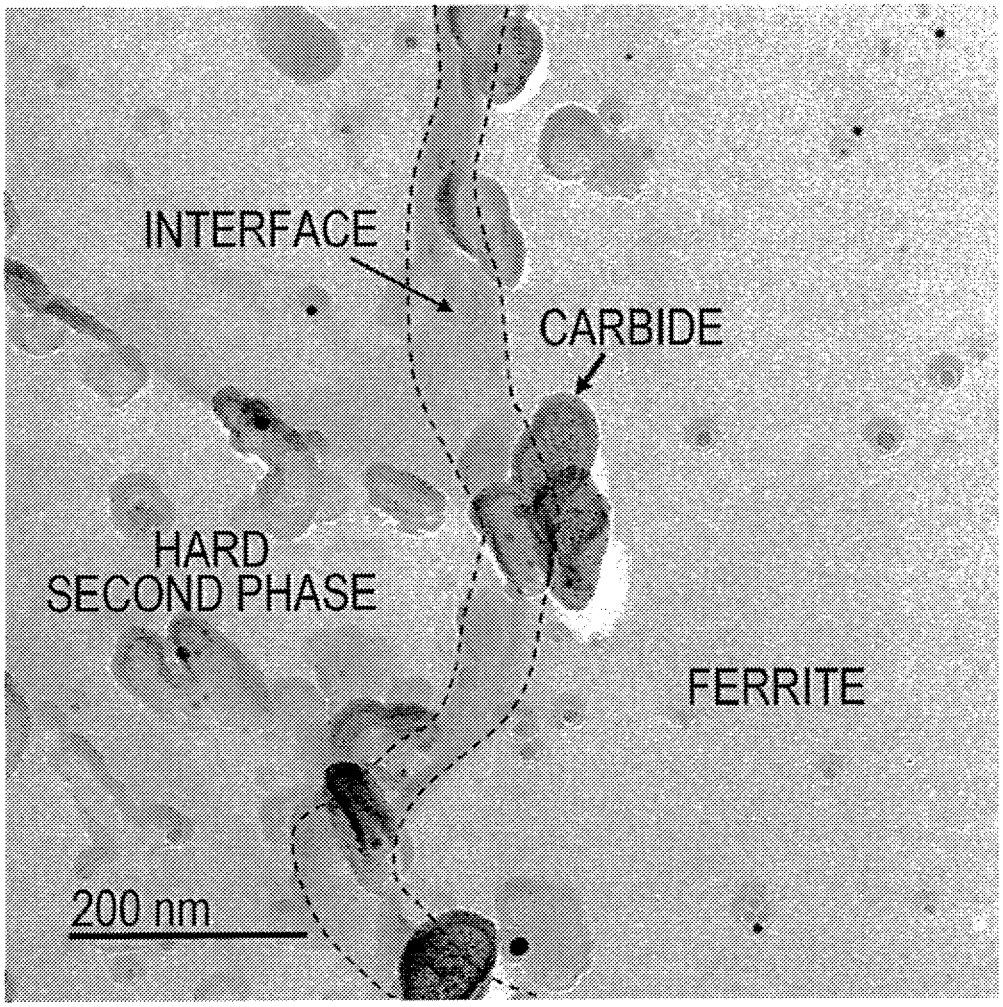
FIG. 3 is an exemplary image of a microstructure.

The obtained results are shown in Table 3. In the present invention, each of the area fractions of ferrite phase, sum of bainite and tempered martensite, as-quenched martensite, and pearlite is the area fraction of the corresponding phase present in an observed area. Each of the area fractions is measured by polishing a sheet section that is parallel to the rolling direction of the steel sheet, performing etching with 1% nital, capturing an image of the microstructure at a position of ¼t (total thickness t) in a sheet thickness direction with a SEM (scanning electron microscope) at 3000× magnification, and performing measuring by point counting with the number of lattice points being 15×15 (at 2-μm intervals). In the SEM image of the microstructure, the bainite or the tempered martensite appears to be a lath-like microstructure. The as-quenched martensite and the retained austenite appear to be white microstructures in the SEM image of the microstructure and are difficult to be identified, and thus the total fraction is measured by point counting. The volume fraction of the retained austenite is a ratio of X-ray diffraction integrated intensity of (200), (220), and (311) planes of fcc iron relative to X-ray diffraction integrated intensity of (200), (211), and (220) planes of bcc iron, both iron being on a surface at ¼ of steel thickness (volume fraction is regarded as area fraction). The area fraction of the as-quenched martensite is calculated by subtracting the volume fraction of the retained austenite, which is measured by X-ray diffraction, from the total area fraction of the martensite and the retained austenite, which is measured by the above-described point counting. In the SEM image of the microstructure, pearlite is a layered microstructure in which a ferrite phase and cementite are alternately stacked on top of each other. Equivalent-circle diameters of 10 carbides present at the interface between the ferrite phase and the hard second phase were measured, and the arithmetic mean was calculated. The area of the carbide was determined, and a diameter of a perfect circle having this area was calculated and regarded as the equivalent-circle diameter of the carbide. FIG. 3 shows the TEM observation image of an extraction replica sample of the carbide particles that are at the interface between the ferrite phase and the hard second phase and that are obtained in the present invention.

Tensile Properties

In order to evaluate the tensile properties, TS (tensile strength) and EL (total elongation) were measured by performing a tensile test in conformity with JIS Z 2241 by using JIS No. 5 test pieces collected such that the tensile direction was a direction perpendicular to the rolling direction of the steel sheet. Furthermore, the hole expansion ratio was measured by performing the hole expanding test in conformity with JIS Z 2256.

In order to evaluate the low-temperature toughness, a Charpy impact test was performed in conformity with JIS Z 2242, and the percent brittle fracture was measured at −40° C. Charpy test pieces were collected such that a steel width direction was a longitudinal direction and the fracture surfaces were parallel to the rolling direction. The test pieces were thin in thickness, and thus the accurate evaluation was difficult by using one piece, so that seven pieces were stacked without spaces and fastened with screws to make a test piece and the test piece was processed to make a Charpy test piece with the predetermined form. The Charpy impact test was performed at −40° C., and the percent brittle fracture was measured by capturing an image of the fracture surfaces and distinguishing a ductile fracture surface and a brittle fracture surface. When the distinction was difficult, the fracture surface was observed with a SEM, and the percent brittle fracture was calculated. [0088]

TABLE 3

| | | Microstructure | | | | | | | Mechanical properties | | | Low-temperature toughness (−40° C.) | |
|---|---|---|---|---|---|---|---|---|---|---|---|---|---|
| No. | Steel | Ferrite area fraction (%) | Hard second phase area fraction (%) | Bainite and tempered martensite area fraction (%) | Retained austenite volume fraction (%) | Martensite area fraction (%) | Pearlite (%) | Average equivalent-circle diameter of carbide at interface between ferrite phase and hard second phase (nm) | TS (MPa) | EL (%) | Hole expansion ratio (%) | Percent brittle fracture (%) | |
| 1 | A | 64 | 36 | 24 | 6 | 6 | 0 | 46 | 732 | 25 | 90 | 5 | I.E. |
| 2 | A | 63 | 37 | 24 | 6 | 7 | 0 | 63 | 660 | 28 | 101 | 10 | I.E. |
| 3 | A | 63 | 37 | 24 | 6 | 7 | 0 | 222 | 660 | 28 | 42 | 70 | C.E. |
| 4 | A | 69 | 31 | 23 | 2 | 6 | 0 | 212 | 613 | 30 | 39 | 90 | C.E. |
| 5 | A | 67 | 33 | 26 | 2 | 5 | 0 | 241 | 635 | 30 | 45 | 90 | C.E. |
| 6 | A | 69 | 31 | 23 | 2 | 6 | 0 | 207 | 626 | 30 | 44 | 85 | C.E. |
| 7 | A | 68 | 32 | 23 | 2 | 6 | 0 | 217 | 621 | 31 | 43 | 80 | C.E. |
| 8 | A | 65 | 35 | 15 | 6 | 14 | 0 | 68 | 760 | 25 | 37 | 5 | I.E. |
| 9 | A | 71 | 29 | 20 | 2 | 3 | 4 | 47 | 585 | 29 | 41 | 5 | C.E. |
| 10 | A | 63 | 37 | 25 | 6 | 6 | 0 | 211 | 711 | 26 | 40 | 85 | C.E. |
| 11 | B | 56 | 44 | 34 | 5 | 5 | 0 | 52 | 901 | 20 | 86 | 0 | I.E. |

TABLE 3-continued

| | | Microstructure | | | | | | | Mechanical properties | | | Low-temperature toughness (−40° C.) | |
|---|---|---|---|---|---|---|---|---|---|---|---|---|---|
| No. | Steel | Ferrite area fraction (%) | Hard second phase area fraction (%) | Bainite and tempered martensite area fraction (%) | Retained austenite volume fraction (%) | Martensite area fraction (%) | Pearlite (%) | Average equivalent-circle diameter of carbide at interface between ferrite phase and hard second phase (nm) | TS (MPa) | EL (%) | Hole expansion ratio (%) | Percent brittle fracture (%) | |
| 12 | B | 55 | 45 | 36 | 5 | 4 | 0 | 76 | 853 | 21 | 85 | 5 | I.E. |
| 13 | B | 76 | 24 | 12 | 6 | 6 | 0 | 153 | 570 | 33 | 81 | 15 | C.E. |
| 14 | B | 6 | 94 | 86 | 1 | 7 | 0 | 160 | 970 | 13 | 72 | 15 | C.E. |
| 15 | B | 54 | 46 | 37 | 6 | 3 | 0 | 205 | 995 | 18 | 41 | 90 | C.E. |
| 16 | C | 32 | 68 | 60 | 5 | 3 | 0 | 51 | 1089 | 17 | 72 | 5 | I.E. |
| 17 | C | 34 | 66 | 58 | 6 | 2 | 0 | 78 | 1063 | 17 | 63 | 10 | I.E. |
| 18 | C | 35 | 65 | 57 | 6 | 2 | 0 | 208 | 1042 | 18 | 42 | 50 | C.E. |
| 19 | C | 48 | 52 | 46 | 5 | 1 | 0 | 232 | 1002 | 18 | 35 | 50 | C.E. |
| 20 | D | 23 | 77 | 70 | 4 | 3 | 0 | 67 | 1123 | 16 | 61 | 5 | I.E. |
| 21 | D | 25 | 75 | 69 | 4 | 2 | 0 | 81 | 1092 | 18 | 69 | 10 | I.E. |
| 22 | D | 86 | 14 | 7 | 3 | 4 | 0 | 255 | 550 | 34 | 38 | 90 | C.E. |
| 23 | E | 17 | 83 | 74 | 7 | 2 | 0 | 93 | 1185 | 15 | 59 | 10 | I.E. |
| 24 | E | 17 | 83 | 74 | 6 | 3 | 0 | 114 | 1144 | 16 | 57 | 10 | I.E. |
| 25 | E | 13 | 87 | 83 | 2 | 2 | 0 | 226 | 1127 | 16 | 33 | 100 | C.E. |
| 26 | F | 21 | 79 | 71 | 4 | 4 | 0 | 103 | 1120 | 16 | 58 | 10 | I.E. |
| 27 | G | 27 | 73 | 66 | 5 | 2 | 0 | 65 | 1153 | 16 | 68 | 5 | I.E. |
| 28 | H | 32 | 68 | 63 | 3 | 2 | 0 | 38 | 1113 | 16 | 65 | 0 | I.E. |
| 29 | I | 58 | 42 | 35 | 5 | 2 | 0 | 73 | 682 | 27 | 96 | 5 | I.E. |
| 30 | J | 23 | 77 | 69 | 3 | 5 | 0 | 91 | 1141 | 16 | 54 | 5 | I.E. |
| 31 | K | 27 | 73 | 67 | 4 | 2 | 0 | 42 | 1052 | 17 | 80 | 0 | I.E. |
| 32 | L | 18 | 82 | 72 | 4 | 6 | 0 | 105 | 1154 | 15 | 57 | 5 | I.E. |
| 33 | M | 37 | 63 | 57 | 4 | 2 | 0 | 81 | 1096 | 16 | 59 | 5 | I.E. |
| 34 | N | 18 | 82 | 72 | 7 | 3 | 0 | 103 | 1194 | 14 | 55 | 5 | I.E. |
| 35 | O | 32 | 68 | 63 | 4 | 1 | 0 | 50 | 1034 | 17 | 73 | 0 | I.E. |
| 36 | P | 60 | 40 | 31 | 5 | 4 | 0 | 70 | 806 | 22 | 89 | 5 | I.E. |
| 37 | Q | 26 | 74 | 66 | 6 | 2 | 0 | 39 | 1073 | 16 | 71 | 0 | I.E. |
| 38 | R | 21 | 79 | 72 | 5 | 2 | 0 | 44 | 1089 | 15 | 66 | 0 | I.E. |
| 39 | S | 89 | 11 | 7 | 2 | 2 | 0 | 17 | 501 | 35 | 106 | 0 | C.E. |
| 40 | T | 15 | 85 | 79 | 5 | 1 | 0 | 216 | 1277 | 13 | 24 | 90 | C.E. |
| 41 | U | 9 | 91 | 83 | 4 | 4 | 0 | 56 | 911 | 14 | 51 | 5 | C.E. |
| 42 | V | 83 | 17 | 9 | 2 | 6 | 0 | 73 | 562 | 35 | 92 | 10 | C.E. |
| 43 | W | 39 | 61 | 49 | 6 | 6 | 0 | 310 | 1310 | 14 | 28 | 90 | C.E. |
| 44 | W | 36 | 64 | 50 | 5 | 9 | 0 | 280 | 1332 | 13 | 32 | 70 | C.E. |
| 45 | W | 37 | 63 | 49 | 6 | 8 | 0 | 275 | 1341 | 13 | 33 | 85 | C.E. |
| 46 | W | 38 | 62 | 48 | 7 | 7 | 0 | 230 | 1331 | 14 | 34 | 65 | C.E. |
| 47 | W | 38 | 62 | 50 | 6 | 6 | 0 | 233 | 1322 | 14 | 31 | 80 | C.E. |
| 48 | W | 37 | 63 | 48 | 7 | 8 | 0 | 151 | 1336 | 13 | 53 | 10 | I.E. |
| 49 | B | 54 | 46 | 35 | 6 | 5 | 0 | 50 | 964 | 21 | 83 | 0 | I.E. |

* Underlined numbers are out of the scope of the present invention.
I.E.: Invention Example,
C.E.: Comparative Example According to Table 3, the steel sheets of Invention Examples have a TS of 590 MPa or more, steel sheets having a TS of 590 MPa or more and less than 690 MPa have an El of 27% or more, steel sheets having a TS of 690 MPa or more and less than 780 MPa have an El of 25% or more, steel sheets having a TS of 780 MPa or more and less than 980 MPa have an El of 19% or more, steel sheets having a TS of 980 MPa or more and less than 1180 MPa have an El of 15% or more, and steel sheets having a TS of 1180 MPa or more have an El of 13% or more. The steel sheets of Invention Examples have a percent brittle fracture of 20% or less. Thus, The steel sheets of Invention Examples exhibit excellent tensile strength, ductility, and low-temperature toughness.

Invention Examples, in which the hard second phase is in the preferable range, have a hole expansion ratio of 50% or more and have excellent stretch flangeability. As described below, No. 8, in which the hard second phase is not in the preferable range, has low stretch flangeability. As described above, the object of the present invention is to provide a high strength steel sheet having excellent ductility and low-temperature toughness, and excellent stretch flangeability is a preferable effect.

In contrast, the steel sheets of Comparative Examples, which are out of the scope of the present invention, are inferior in terms of at least one property of the tensile strength, the ductility, and the low-temperature toughness.

In No. 3, the finishing temperature in the hot rolling is out of the scope of the present invention and falls below the $Ar_3$ transformation temperature. Thus, the average equivalent-circle diameter of a carbide at the interface between the ferrite phase and the hard second phase is out of the scope of the present invention and exceeds 200 nm, and the percent brittle fracture exceeds 20%, which shows that the low-temperature toughness deteriorates.

In No. 4, the coiling temperature in the hot rolling is out of the scope of the present invention and exceeds 550° C. Thus, the average equivalent-circle diameter of a carbide at the interface between the ferrite phase and the hard second phase is out of the scope of present invention and exceeds 200 nm, and the percent brittle fracture exceeds 20%, which shows that the low-temperature toughness deteriorates.

In No. 5, the average heating rate in the temperature range of 500° C. to the $Ac_1$ transformation temperature is out of the scope of the present invention and falls below 10° C./s. Thus, the average equivalent-circle diameter of a carbide at the interface between the ferrite phase and the hard second phase is out of the scope of the present invention and exceeds 200 nm, and the percent brittle fracture exceeds 20%, which shows that the low-temperature toughness deteriorates.

In No. 6, the average cooling rate in the hot rolling is out of the scope of the present invention and falls below 20° C./s. Thus, the average equivalent-circle diameter of a carbide at the interface between the ferrite phase and the hard second phase is out of the scope of the present invention and exceeds 200 nm, and the percent brittle fracture exceeds 20%, which shows that the low-temperature toughness deteriorates.

In No. 7, the temperature during performing retaining after the cooling stops is out of the scope of the present invention and exceeds 350° C. Thus, the average equivalent-circle diameter of a carbide at the interface between the ferrite phase and the hard second phase is out of the scope of the present invention and exceeds 200 nm, and the percent brittle fracture exceeds 20%, which shows that the low-temperature toughness deteriorates.

In No. 9, the average cooling rate is out of the scope of the present invention and falls below 10° C./s. Thus, the area fractions of the ferrite phase and the hard second phase are out of the scope of the present invention, and TS falls below 590 MPa, which shows that the strength deteriorates, and the hole expansion ratio falls below 50%, which shows that the stretch flangeability deteriorates.

In No. 10, the retention time in the temperature range of the alloying treatment is out of the scope of the present invention and exceeds 30 seconds. Thus, the average equivalent-circle diameter of a carbide at the interface between the ferrite phase and the hard second phase is out of the scope of the present invention and exceeds 200 nm, and the percent brittle fracture exceeds 20%, which shows that the low-temperature toughness deteriorates.

In No. 13, the retention time in the temperature range of 750° C. to 900° C. is out of the scope of the present invention and falls below 10 seconds. Thus, the area fraction of the hard second phase is out of the scope of the present invention and falls below 30%, and TS falls below 590 MPa, which shows that the strength deteriorates.

In No. 14, the heating temperature is out of the scope of the present invention and exceeds 900° C. Thus, the area fraction of the ferrite phase is out of the scope of the present invention and falls below 10%, the area fraction of the hard second phase is out of the scope of the present invention and exceeds 90%, and El falls below 19%, which shows that the ductility deteriorates.

In No. 15, the average heating rate to the sheet temperature at which the sheet is immersed in a hot-dip galvanizing bath is out of the scope of the present invention and falls below 30° C./s. Thus, the average equivalent-circle diameter of a carbide at the interface between the ferrite phase and the hard second phase is out of the scope of the present invention and exceeds 200 nm, and the percent brittle fracture exceeds 20%, which shows that the low-temperature toughness deteriorates.

In No. 18, the cooling stop temperature is 150° C. or lower, and the average heating rate applied after the cooling stops is out of the scope of the present invention and falls below 30° C./s. Thus, the average equivalent-circle diameter of a carbide at the interface between the ferrite phase and the hard second phase is out of the scope of the present invention and exceeds 200 nm, and the percent brittle fracture exceeds 20%, which shows that the low-temperature toughness deteriorates.

In No. 19, the retention time taken after the cooling stops is out of the scope of the present invention and exceeds 600 seconds. Thus, the average equivalent-circle diameter of a carbide at the interface between the ferrite phase and the hard second phase is out of the scope of the present invention and exceeds 200 nm, and the percent brittle fracture exceeds 20%, which shows that the low-temperature toughness deteriorates.

In No. 22, the heating temperature is out of the scope of the present invention and falls below 750° C. Thus, the area fraction of the hard second phase is out of the scope of the present invention and falls below 30%, the total area fraction of the bainite and the tempered martensite is out of the scope of the present invention and falls below 10%, and TS falls below 590 MPa, which shows that the strength deteriorates.

In No. 25, the average heating rate to the temperature of the alloying treatment is out of the scope of the present invention and falls below 30° C./s. Thus, the average equivalent-circle diameter of a carbide at the interface between the ferrite phase and the hard second phase is out of the scope of the present invention and exceeds 200 nm, and the percent brittle fracture exceeds 20%, which shows that the low-temperature toughness deteriorates.

In No. 39, the amount of C is out of the scope of the present invention and falls below 0.05%. Thus, the area fraction of the hard second phase is out of the scope of the present invention and falls below 30%, and TS falls below 590 MPa, which shows that the strength deteriorates.

In No. 40, the amount of C is out of the scope of the present invention and exceeds 0.30%. Thus the average equivalent-circle diameter of a carbide at the interface between the ferrite phase and the hard second phase is out of the scope of the present invention and exceeds 200 nm, and the percent brittle fracture exceeds 20%, which shows that the low-temperature toughness deteriorates.

In No. 41, the amount of Mn is out of the scope of the present invention and exceeds 3.5%. Thus, the area fraction of the ferrite phase is out of the scope of the present invention and falls below 10%, the area fraction of the hard second phase is out of the scope of the present invention and exceeds 90%, and El falls below 19%, which shows that the ductility deteriorates.

In No. 42, the amount of Mn is out of the scope of the present invention and falls below 0.5%. Thus, TS falls below 590 MPa, which shows that the strength deteriorates.

In No. 43 to 47, imitations of the coated steel sheet in No. 15 of Example in Patent Literature 1 were used. The steel sheets in No. 43 to 47 are out of the scope of the present invention. Thus, the percent brittle fracture exceeds 20%, which shows that the low-temperature toughness deteriorates. In contrast, in No. 48, the steel sheet is in the scope of the present invention and has a TS of 1180 MPa or more, an El of 13% or more, a hole expansion ratio of 50% or more, and a brittle fracture of 20% or less. This shows that the tensile strength, the ductility, and the low-temperature toughness are excellent.

The invention claimed is:

1. A high strength steel sheet comprising:

a composition containing, on a mass % basis, C: 0.05% to 0.30%, Si: 0.5% to 2.5%, Mn: 0.5% to 3.5%, P: 0.003% to 0.100%, S: 0.02% or less, Al: 0.010% to 1.5%, and N: 0.01% or less, the balance being Fe and unavoidable impurities; and a steel microstructure including a ferrite phase with an area fraction of 10% to 70%, a hard second phase with an area fraction of 30% to 90%, and a carbide that is present at an interface between the ferrite phase and the hard second phase and that has an average equivalent-circle diameter of 200 nm or less.

2. The high strength steel sheet according to claim 1, wherein the composition further contains, on a mass% basis, one or more elements selected from Group A, B, C and D;

Group A

Cr: 0.005% to 2.00%, Mo: 0.005% to 2.00%, V: 0.005% to 2.00%, Ni: 0.005% to 2.00%, and Cu: 0.005% to 2.00%

Group B

Ti: 0.01% to 0.20% and Nb: 0.01% to 0.20%

Group C

B: 0.0002% to 0.01%

Group D

Sb: 0.001% to 0.05% and Sn: 0.001% to 0.05%.

3. The high strength steel sheet according to claim 1, wherein the hard second phase includes bainite and tempered martensite, and the bainite and the tempered martensite have an area fraction of 10% to 90% in total.

4. The high strength steel sheet according to claim 1, wherein the hard second phase includes as-quenched martensite, and the as-quenched martensite has an area fraction of 10% or less.

5. The high strength steel sheet according to claim 1, wherein the hard second phase includes retained austenite, and the retained austenite has an area fraction of 10% or less.

6. The high strength steel sheet according to claim 1, wherein the hard second phase includes pearlite, and the pearlite has an area fraction of 3% or less.

7. The high strength steel sheet according to claim 1, comprising a galvanizing layer on a surface of the high strength steel sheet.

8. A method for producing a high strength steel sheet according to claim 1 comprising:

a hot-rolling step of rolling a slab having the composition according to claim 1 at a finishing temperature that is $Ar_3$ transformation temperature or higher, then performing cooling at an average cooling rate of 20° C./s or more, and performing coiling at 550° C. or lower;

a pickling step of removing an oxide scale of a surface of a hot-rolled steel sheet obtained in the hot-rolling step by performing pickling;

a cold-rolling step of cold-rolling a pickled sheet after the pickling step; and an annealing step of heating a cold-rolled steel sheet obtained in the cold-rolling step to a temperature of 750° C. to 900° C. while heating the steel sheet at an average heating rate of 10° C./s or more in a temperature range of 500° C. to $Ac_1$ transformation temperature and cooling the steel sheet to a cooling stop temperature lower than or equal to (Ms temperature—100° C.) while cooling the steel sheet at an average cooling rate of 10° C./s or more to a temperature of (Ms temperature—100° C.), wherein a retention time in the temperature range of 750° C. to 900° C. is 10 seconds or more in the heating and the cooling, wherein when the cooling stop temperature falls below 150° C., after the cooling is performed to a temperature lower than or equal to (Ms temperature—100° C.), the steel sheet is heated at an average heating rate of 30° C./s or more to a temperature of 150° C. or higher and 350° C. or lower and retained in a temperature range of 150° C. or higher and 350° C. or lower for 10 seconds or more and 600 seconds or less, and wherein when the cooling stop temperature is 150° C. or higher, after the cooling is performed to a temperature lower than or equal to (Ms temperature—100° C.), the steel sheet is heated at an average heating rate of 30° C./s or more to a temperature of 150° C. or higher and 350° C. or lower and retained in a temperature range of 150° C. or higher and 350° C. or lower for 10 seconds or more and 600 seconds or less, or after the cooling is performed to a temperature lower than or equal to (Ms temperature—100° C.), the steel sheet is retained in a temperature range of 150° C. or higher and 350° C. or lower for 10 seconds or more and 600 seconds or less.

9. The method for producing a high strength steel sheet according to claim 8, the method comprising, after the annealing step, a galvanizing step of heating an annealed sheet at an average heating rate of 30° C./s or more to a sheet temperature at which the sheet is immersed in a hot-dip galvanizing bath and performing hot-dip galvanizing.

10. The method for producing a high strength steel sheet according to claim 9, wherein the galvanizing step includes, after the hot-dip galvanizing, performing alloying treatment by performing heating at an average heating rate of 30° C./s or more to a temperature range of 500° C. to 570° C. and performing retention in the temperature range for a retention time of 30 seconds or less.

11. The high strength steel sheet according to claim 2, wherein the hard second phase includes bainite and tempered martensite, and the bainite and the tempered martensite have an area fraction of 10% to 90% in total.

12. The high strength steel sheet according to claim 2, wherein the hard second phase includes as-quenched martensite, and the as-quenched martensite has an area fraction of 10% or less.

13. The high strength steel sheet according to claim 2, wherein the hard second phase includes retained austenite, and the retained austenite has an area fraction of 10% or less.

14. The high strength steel sheet according to claim 2, wherein the hard second phase includes pearlite, and the pearlite has an area fraction of 3% or less.

15. The high strength steel sheet according to claim 2, comprising a galvanizing layer on a surface of the high strength steel sheet.

16. A method for producing a high strength steel sheet according to claim 2 comprising:

a hot-rolling step of rolling a slab having the composition according to claim 2 at a finishing temperature that is $Ar_3$ transformation temperature or higher, then performing cooling at an average cooling rate of 20° C./s or more, and performing coiling at 550° C. or lower;

a pickling step of removing an oxide scale of a surface of a hot-rolled steel sheet obtained in the hot-rolling step by performing pickling;

a cold-rolling step of cold-rolling a pickled sheet after the pickling step; and an annealing step of heating a cold-rolled steel sheet obtained in the cold-rolling step to a temperature of 750° C. to 900° C. while heating the steel sheet at an average heating rate of 10° C./s or more in a temperature range of 500° C. to $Ac_1$ transformation temperature and cooling the steel sheet to a cooling stop temperature lower than or equal to (Ms temperature—100° C.) while cooling the steel sheet at an average cooling rate of 10° C./s or more to a temperature of (Ms temperature—100° C.), wherein a retention time in the temperature range of 750° C. to 900° C. is 10 seconds or more in the heating and the cooling, wherein when the cooling stop temperature falls below 150° C., after the cooling is performed to a temperature lower than or equal to (Ms temperature—100° C.), the steel sheet is heated at an average heating rate of 30° C./s or more to a temperature of 150° C. or higher and 350° C. or lower and retained in a temperature range of 150° C. or higher and 350° C. or lower for 10 seconds or more and 600 seconds or less, and wherein when the cooling stop temperature is 150° C. or higher, after the cooling is performed to a temperature lower than or equal to (Ms temperature—100° C.), the steel sheet is heated at an average heating rate of 30° C./s or more to a temperature of 150° C. or higher and 350° C. or lower and retained in a temperature range of 150° C. or higher and 350° C. or lower for 10 seconds or more and 600 seconds or less, or after the cooling is performed to a temperature lower than or equal to (Ms temperature—100° C.), the steel sheet is retained in a temperature range of 150° C. or higher and 350° C. or lower for 10 seconds or more and 600 seconds or less.

17. The method for producing a high strength steel sheet according to claim 16, the method comprising, after the annealing step, a galvanizing step of heating an annealed sheet at an average heating rate of 30° C./s or more to a sheet temperature at which the sheet is immersed in a hot-dip galvanizing bath and performing hot-dip galvanizing.

18. The method for producing a high strength steel sheet according to claim 17, wherein the galvanizing step includes, after the hot-dip galvanizing, performing alloying treatment by performing heating at an average heating rate of 30° C./s or more to a temperature range of 500° C. to 570° C. and performing retention in the temperature range for a retention time of 30 seconds or less.

19. The high strength steel sheet according to claim 3, wherein the hard second phase includes bainite and tempered martensite, and the bainite and the tempered martensite have an area fraction of 10% to 90% in total.

20. The high strength steel sheet according to claim 3, wherein the hard second phase includes as-quenched martensite, and the as-quenched martensite has an area fraction of 10% or less.

21. The high strength steel sheet according to claim 1, wherein the high strength steel sheet has a hole expansion ratio of 50% or more, measured by performing the hole expanding test in conformity with JIS Z 2256.

* * * * *